US010967495B2

(12) United States Patent
Webster

(10) Patent No.: US 10,967,495 B2
(45) Date of Patent: Apr. 6, 2021

(54) POWER TOOL

(71) Applicant: Webster Technologies Limited, Sheffield (GB)

(72) Inventor: Ian Frederick Webster, Sheffield (GB)

(73) Assignee: Webster Technologies Limited, Sheffield (GB)

( * ) Notice: Subject to any disclaimer, the term of this patent is extended or adjusted under 35 U.S.C. 154(b) by 81 days.

(21) Appl. No.: 16/040,503

(22) Filed: Jul. 19, 2018

(65) Prior Publication Data

US 2019/0039224 A1 Feb. 7, 2019

(30) Foreign Application Priority Data

Jul. 21, 2017 (GB) ..... 1711765

(51) Int. Cl.
*B25D 9/12* (2006.01)
*B25D 17/24* (2006.01)
*B25D 9/06* (2006.01)

(52) U.S. Cl.
CPC ..... *B25D 9/125* (2013.01); *B25D 9/06* (2013.01); *B25D 17/24* (2013.01); *B25D 2216/0015* (2013.01); *B25D 2217/0073* (2013.01); *B25D 2222/72* (2013.01); *B25D 2250/045* (2013.01); *B25D 2250/121* (2013.01); *B25D 2250/125* (2013.01); *B25D 2250/131* (2013.01); *B25D 2250/371* (2013.01)

(58) Field of Classification Search
CPC ..... B25D 9/125; B25D 9/06; B25D 11/06; B25D 11/10; E01C 23/124
USPC ..... 173/124, 205
See application file for complete search history.

(56) References Cited

U.S. PATENT DOCUMENTS

| | | | | |
|---|---|---|---|---|
| 2,436,450 A | | 2/1948 | Price | |
| 3,010,431 A | | 11/1961 | Holdo | |
| 3,244,241 A | * | 4/1966 | Ferwerda | B25D 16/00 173/105 |
| 3,302,732 A | * | 2/1967 | Roll | E01C 23/124 173/205 |
| 3,312,293 A | * | 4/1967 | Cutler | E01C 23/124 173/202 |
| 3,321,033 A | * | 5/1967 | Benuska | E01C 23/124 173/204 |
| 3,358,779 A | * | 12/1967 | Cunningham | E01C 23/124 173/202 |
| 3,938,427 A | | 2/1976 | Warrington | |
| 4,106,573 A | | 8/1978 | Bailey | |
| 4,645,015 A | * | 2/1987 | Mitchell | B25D 11/10 173/115 |

(Continued)

FOREIGN PATENT DOCUMENTS

| | | |
|---|---|---|
| CA | 2303648 A1 | 9/2001 |
| GB | 191116380 | 7/1912 |

(Continued)

*Primary Examiner* — Hemant Desai
*Assistant Examiner* — Jacob A Smith
(74) *Attorney, Agent, or Firm* — TannerIP PLLC; Daniel A. Tanner, III; James E. Golladay, II

(57) ABSTRACT

A power tool including an impact tool, a body and an actuator. The actuator is operable to move the body along an operational axis from an impact position, at which the body is operable to transfer impact energy to a head end of the impact tool, to a retracted position spaced apart from the impact position along the operational axis.

20 Claims, 14 Drawing Sheets

(56) References Cited

U.S. PATENT DOCUMENTS

| | | | | |
|---|---|---|---|---|
| 4,747,466 | A * | 5/1988 | Jaworski | B25D 11/06 181/113 |
| 4,852,662 | A * | 8/1989 | Bianchi | B25D 9/00 173/203 |
| 4,984,640 | A | 1/1991 | Gillan et al. | |
| 5,407,017 | A | 4/1995 | Wehr et al. | |
| 5,467,684 | A * | 11/1995 | Sher | A61B 17/320758 74/129 |
| 5,769,172 | A * | 6/1998 | Sher | A61B 17/320758 173/111 |
| 7,059,423 | B1 * | 6/2006 | Hoggarth | B25D 11/06 173/114 |
| 2004/0159452 | A1 * | 8/2004 | Garvey | B25D 11/06 173/210 |
| 2008/0190632 | A1 | 8/2008 | Berger et al. | |
| 2010/0252289 | A1 | 10/2010 | Aoki | |
| 2013/0048326 | A1 * | 2/2013 | Stoner | B25D 9/08 173/133 |
| 2013/0206436 | A1 | 8/2013 | Thorson et al. | |
| 2015/0129269 | A1 * | 5/2015 | Muuttonen | B25D 17/245 173/105 |
| 2015/0196997 | A1 * | 7/2015 | McClung | B25B 21/026 173/93 |
| 2016/0201353 | A1 | 7/2016 | Niekamp | |
| 2016/0288306 | A1 * | 10/2016 | Pillers, II | B25D 17/245 |
| 2016/0333542 | A1 * | 11/2016 | Jinnings | E02D 7/10 |
| 2017/0101747 | A1 * | 4/2017 | Borgers | E01C 23/122 |

FOREIGN PATENT DOCUMENTS

| | | | |
|---|---|---|---|
| GB | 0236910 | A | 6/1925 |
| GB | 2375319 | A | 11/2002 |
| JP | 56-167022 | A | 12/1981 |
| JP | 2013144346 | A | 7/2013 |
| KR | 101575059 | B1 | 12/2015 |
| WO | 1991/010542 | A1 | 7/1991 |
| WO | 1995/002093 | A2 | 1/1995 |
| WO | 00/41851 | A1 | 7/2000 |
| WO | 2004/029400 | A1 | 4/2004 |

* cited by examiner

POWER TOOL

The present disclosure relates to a power tool.

BACKGROUND

Hydraulic breakers for cutting masonry are well known. Typically they incorporate a weight which is raised against gravity by using hydraulics. The weight is driven into an accumulator and the combination of hydraulics and the accumulator are used to drive the weight against a drill bit delivering an impact force to a masonry target.

FIG. 1 shows an alternative power tool as described in GB2375319B (BACA Limited). The tool 1 comprises a cuboid structural casing 2 to carry upper handles 4,6, and a work piece 8 in the form of a chisel. Inside, and further supported by, the casing there is a hydraulic ram 10 mounted through a platform 12. The ram comprises a cylinder 14 and a piston 16. Mounted onto a moving platform 18 there is a body 20 in the form of a heavy weight. Mounted between the moving platform and the bottom wall of the jackhammer are two elastic ropes 22,24 and shock absorbers 26,28. The jackhammer is shown in a vertical orientation with the chisel lower-most at the foot of the jackhammer.

The ram cylinder comprises a clutch which must capture and release the body 20 with each cycle. The clutch may be prone to wear which may result in mis-capture or pre-mature release if not maintained properly, resulting in a lack of effectiveness of the device.

The moving platform 18 slides on the exterior surface of the ram cylinder 14. This necessitates the need for the external surface of the ram cylinder 14 to be machined to a close tolerance. It also introduces extra loads and wear on the ram cylinder. If the moving platform is not aligned correctly on the ram, its movement along the ram cylinder may create unwanted vibration and resistance.

Additionally since the casing 2 is structural, with the other tool components being mounted off the casing 2, it comprises a casting of robust and heavy design. Hence the casing contributes significantly to the overall weight of the power tool.

Hence, a power tool which provides the advantages of the device of FIG. 1, but delivers a higher impact force per unit weight of the power tool, and provides an improved actuator and body interface, is highly desirable.

SUMMARY

According to the present disclosure there is provided an apparatus and method as set forth in the appended claims. Other features of the invention will be apparent from the dependent claims, and the description which follows.

Accordingly there may be provided a power tool (30) comprising: an impact tool (42) having a head end (60); a body (70) comprising: a first flange (74) comprising: a first engagement land (76) and a first engagement edge (78); a first actuator (46) for moving the body (70) along an operational axis (38): from an impact position at which the body (70) is operable to transfer impact energy to the head end (60) of the impact tool (42) to a retracted position spaced apart from the impact position along the operational axis (38). The first actuator (46) may comprise: a first actuator rotational axis (80), and a first engagement member (82) offset from, and rotatable around, the first actuator rotational axis (80), the first engagement member (82) and first flange (74) arranged relative to each such that: at the impact position the first engagement member (82) is operable to engage with the first flange engagement edge (78), and as the first engagement member (82) rotates around the first actuator rotational axis (80), the first engagement member (82): travels along the first flange (74) engagement land; and simultaneously urges the body (70) in a direction away from the body (70) impact position towards the body (70) retracted position; and at the retracted position the first engagement member (82) is operable to move past the first flange engagement edge (78) to thereby disengage the body (70) from the first engagement member (82), thereby permitting the body (70) to move on an impact stroke to the impact position.

The body (70) may comprise: a second flange (174) comprising: a second engagement land (176), and a second engagement edge (178); a second actuator (146) for moving the body (70) along the operational axis (38).

The power tool may further comprise: a second actuator rotational axis (180), a second engagement member (182) offset from, and rotatable around, the second actuator rotational axis (180). The second engagement member (182) and second flange (174) may be arranged relative to each other such that: at the impact position the second engagement member (182) is operable to engage with the second flange engagement edge (178), and as the second engagement member (182) rotates around the second actuator rotational axis (180), the second engagement member (182): travels along the second flange engagement land (176); and simultaneously urges the body (70) in a direction away from the body (70) impact position towards the body (70) retracted position. At the retracted position the second engagement member (182) may be operable to move past the second flange engagement edge (178) to thereby disengage the body (70) from the second engagement member (182), thereby permitting the body (70) to move on an impact stroke to the impact position.

The first engagement member (82) and second engagement member (182) may be operable to rotate about their respective actuator axes; and may be operable such that: the first engagement member (82) engages with the first flange engagement edge (78) at the same instant as the second engagement member (182) engages with the second flange engagement edge (178); and the first engagement member (82) disengages from the first flange engagement edge (78) at the same instant as the second engagement member (182) disengages from the second flange engagement edge (178).

The first actuator rotational axis (80) may be perpendicular to the operational axis (38).

The second actuator rotational axis (180) may be perpendicular to the operational axis (38).

The first actuator rotational axis (80) may be aligned with the second actuator rotational axis (180).

A plane defined by the operational axis (38) and first actuator rotational axis (80) may be coplanar with a surface (79) of the first engagement edge (78).

The first flange engagement edge (78) may be aligned with the first actuator rotational axis (80).

The second flange engagement edge (178) may be aligned with the second actuator rotational axis (180).

A plane defined by the operational axis (138) and second actuator rotational axis (180) may be coplanar with a surface (179) of the second engagement edge (178).

The first flange engagement edge (78) may be aligned with the second flange engagement edge (178).

The surface (79) of the first flange engagement edge (78) may be coplanar with the surface (179) of the second flange engagement edge (178).

The first flange (74) may extend away from the first flange engagement edge (78) in a first direction away from the first actuator rotational axis (80). The second flange (174) may extend away from the second flange engagement edge (178) in a second direction away from the second actuator rotational axis (180). The first direction may be in an opposite direction to the second direction.

The first actuator (46) and second actuator (146) may be operable to be hydraulically actuated. Each of the first actuator (46) and second actuator (146) may comprise a fluid coupling for fluid communication with a fluid supply to drive the actuators (46, 146). The fluid supply of the first actuator (46) and second actuator (146) may be controllable such that the fluid supply pressure to both actuators (46, 146) is matched.

The fluid supply of the first actuator (46) and second actuator (146) may be in fluid communication with each other.

The power tool (30) may further comprise a plurality of rods (90) held in a fixed relationship to one another by: a first mount (92) towards one end of the rods (90), and a second mount (94) spaced apart from the first mount (92) along the operational axis (38) towards an opposite end of the rods (90).

The second mount (94) may be provided with an aperture (96) through which the impact tool (42) extends.

The body (70) may define passages (98) in slideable engagement with at least some of the rods (90), the passages (98) being configured such that the body (70) may translate between the impact position and the retracted position along at least said rods (90).

The body (7) may define passages (98), each of the passages (98) accommodating one of the rods (90), the passages (98) being configured such that the body (70) may translate between the impact position and the retracted position along said rods (90) accommodated in the passages (98).

The body (70) may be in slideable engagement with at least some of the rods (90).

The internal surfaces of the passages (98) of the body (70) may be in slideable engagement with at least some of the rods (90).

A first bearing unit (200) may be provided in each of the passages (98), the first bearing unit (200) configured to bear upon the rod (90) accommodated therein.

A second bearing unit (202) may be provided in each of the passages (98), the second bearing unit (202) configured to bear upon the rod (90) accommodated therein, the second bearing unit spaced apart from the first bearing unit (202) along the length of the passage (98).

One end of an array of elastic ropes (100) may be coupled to the body (70) and another end of the elastic ropes (100) is coupled to a third mount (102).

The array of ropes (100) may be configured such that: the body (70) may translate from the impact position to the retracted position in a retraction direction along its carrying rods (90) under the action of the actuator (46, 146) and against the force developed by the elastic ropes (100). The body (70) may be biased to move in an impact direction along said rods (90) towards its impact position from its retracted position by the elastic ropes (100) whilst uncoupled from the actuator (46, 146).

A first casing (34) may extend between the first mount (92) and the second mount (94). A second casing (36) may extend from the second mount (94) along the operational axis (38). The second casing (36) may terminate in an end plate (104). The impact tool (42) may extend out of an aperture (106) in the end plate (104).

The impact tool (42) may comprise a tool carrier (42) comprising: a foot end (64) at an opposite end of the impact tool (42) to the head end (60), the foot end (64) being provided with a tool mount (66) configured to transmit the impact energy to a tool.

The impact tool (42) may comprise a tool carrier (42, 214) comprising: a base member (210) aligned with the operational axis (38), the head end (60) of the impact tool (42) provided at one end of the base member (210) for receiving impact energy, the base member (210) having: a foot end (64) at an opposite end of the impact tool (42) to the head end (60), the foot end (64) being provided with a tool mount (66) configured to transmit the impact energy to a tool; and a casing engagement feature (212) provided between the head end (60) and foot end (64); and at least part of the tool carrier (42) being located within the second casing (36); the second casing (36) being provided with a tool carrier engagement feature (218) complementary in shape to, and for interlocking engagement with, the tool carrier casing engagement feature (212); to thereby: prevent rotation of the tool carrier (42) relative to the second casing (36) and around the operational axis (38), and permit relative movement between the tool carrier (42) and the second casing (36) along the operational axis (38). The tool carrier casing engagement feature (212) comprises a lug (220) which: extends longitudinally along part of the length of the tool carrier base member (210) such that, in use, the lug (220) is aligned with the operational axis (38) of the power tool (30); the second casing engagement feature (218) is provided as a groove (222) configured to receive the lug (220) of the tool carrier casing engagement feature (212), the groove (220) being aligned with the operational axis (38) of the power tool (30); and configured to permit the tool carrier (42) to move relative to the casing (36) along the operational axis (38).

A support land (110) may extend from the impact tool (42) part of the way between the head end (60) and the foot end (64). A first damping member (112) is provided between the support land (110) and second mount (94). A second damping member (114) may be provided between the support land (110) and the second casing (36) end plate (104).

A support land (110) may extend from the impact tool (42) base member (210) part of the way between the head end (60) and the foot end (64). A first damping member (112) is provided between the support land (110) and second mount (94); and a second damping member (114) is provided between the support land (110) and the second casing (36) end plate (104).

The support land (110) may extend radially outwards from the tool carrier base member (210), each of the lugs (220) extending radially outwards from the support land (110).

The body (70) may be operable to travel along the operational axis (38) between: the impact position; and a rest position spaced apart from the impact position; wherein at the rest position the first engagement member (82) is spaced apart from the first flange (74) as the first engagement member (82) rotates about the first rotational axis (80).

At the rest position the second engagement member (182) may be spaced apart from the second flange (74) as the second engagement member (182) rotates about the second rotational axis (180).

There may also be provided a method of applying a percussive force to an object, using a power tool (30) as claimed in any preceding claims.

Hence there is provided a power tool with an improved "catch and release" interface between an actuator and a body to deliver an impulsive force to a tool. The interface provides positive engagement and dis-engagement as well as being technically simpler and more reliable than an arrangement of the related art.

BRIEF DESCRIPTION OF THE DRAWINGS

Examples of the present disclosure will now be described with reference to the accompanying drawings, in which.

DETAILED DESCRIPTION

Figure 2:
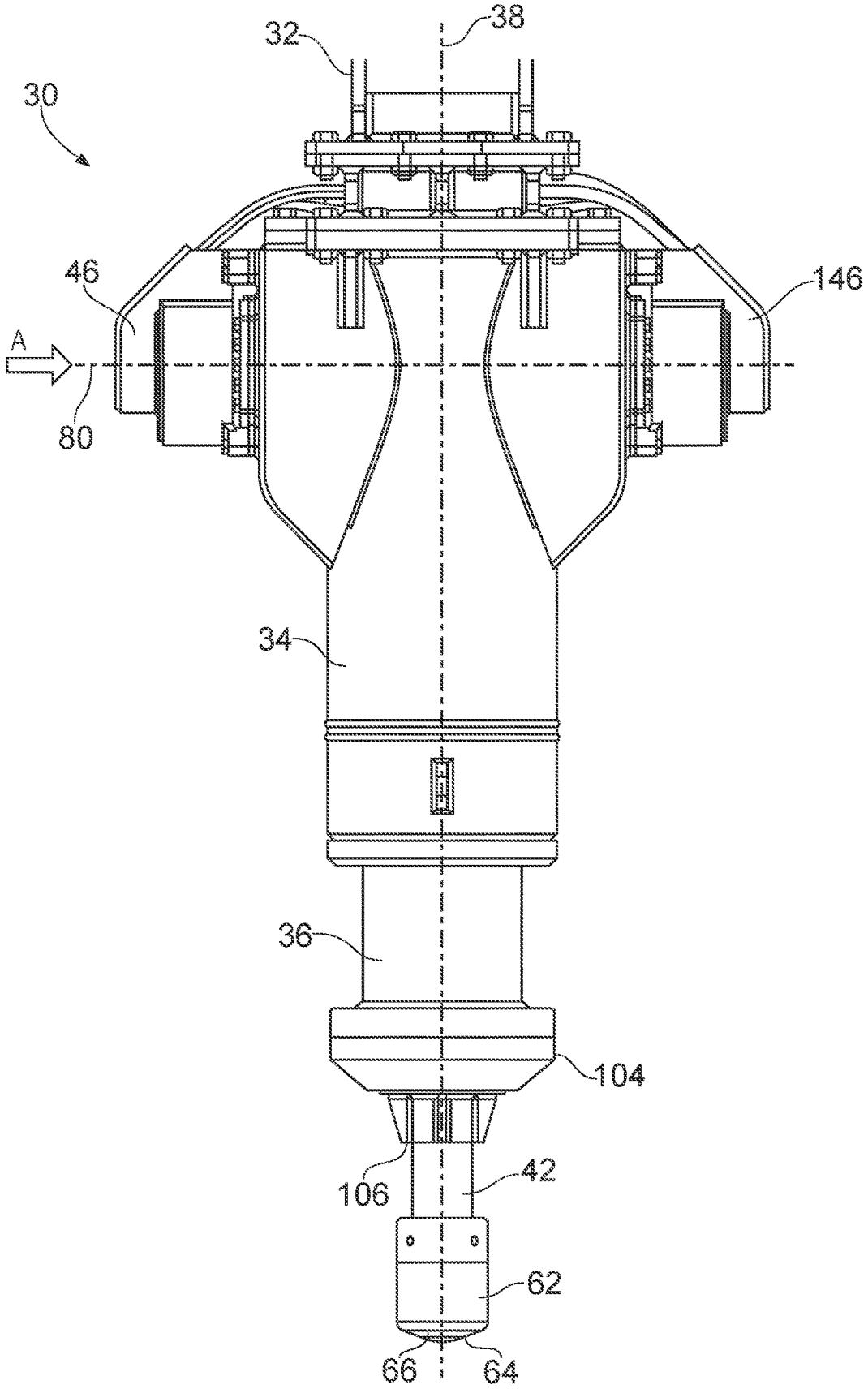
FIG. 2 shows a front view of a power tool according to the present disclosure.
Figure 3:
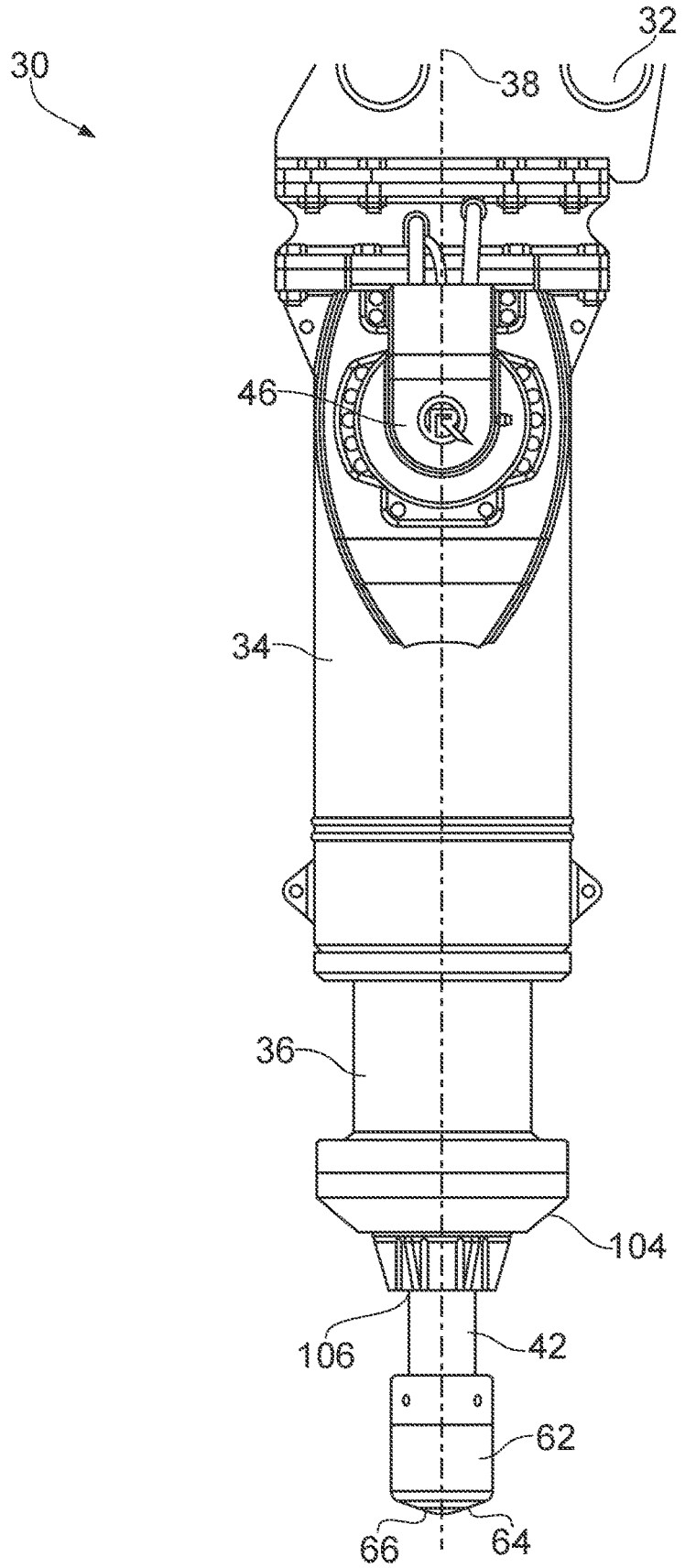
FIG. 3 shows a side view of the arrangement of FIG. 2 as viewed in the direction of arrow "A" shown in FIG. 2.
Figure 4:
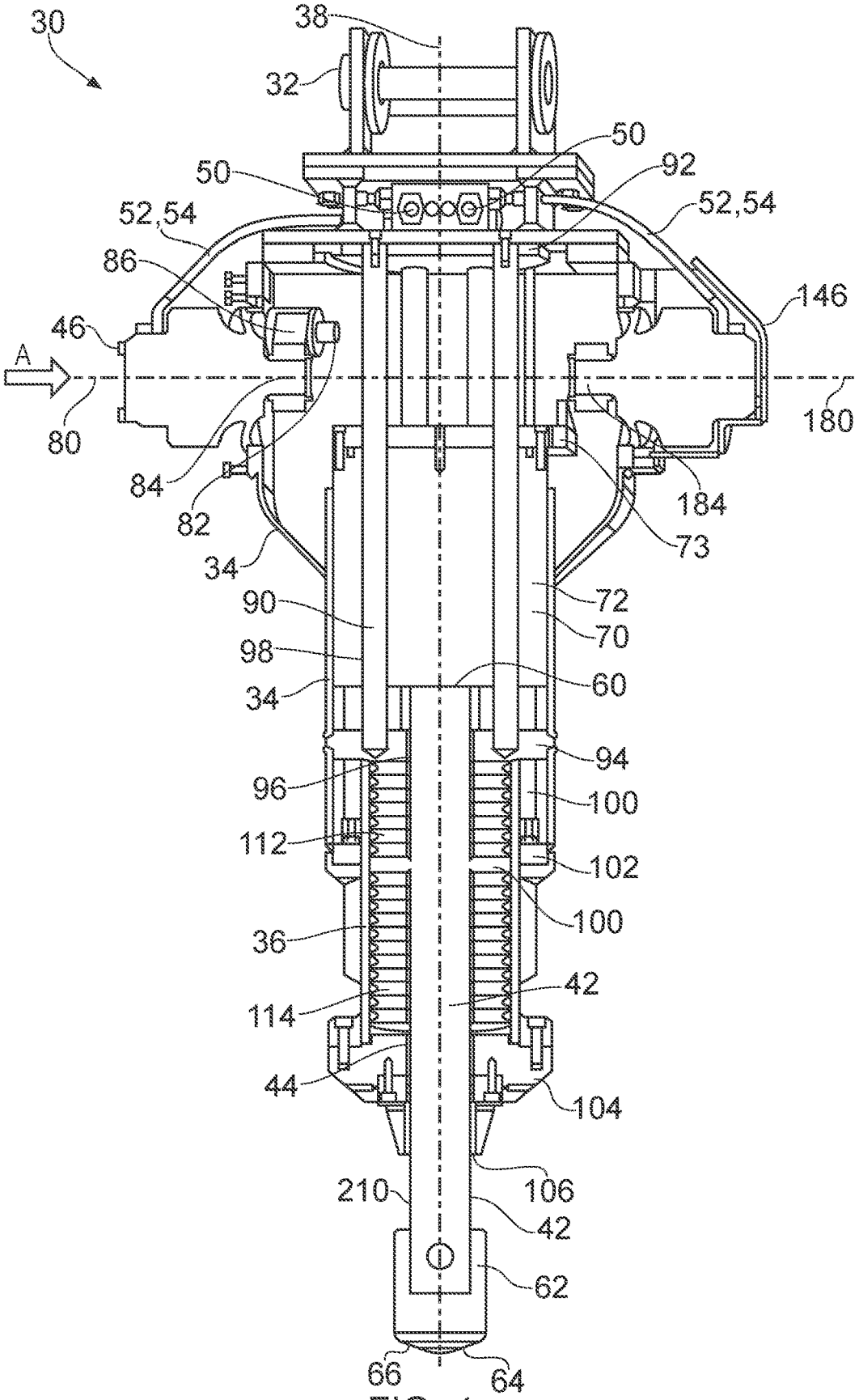
FIG. 4 shows a sectional view of the arrangement shown in FIG. 2.
Figure 5:
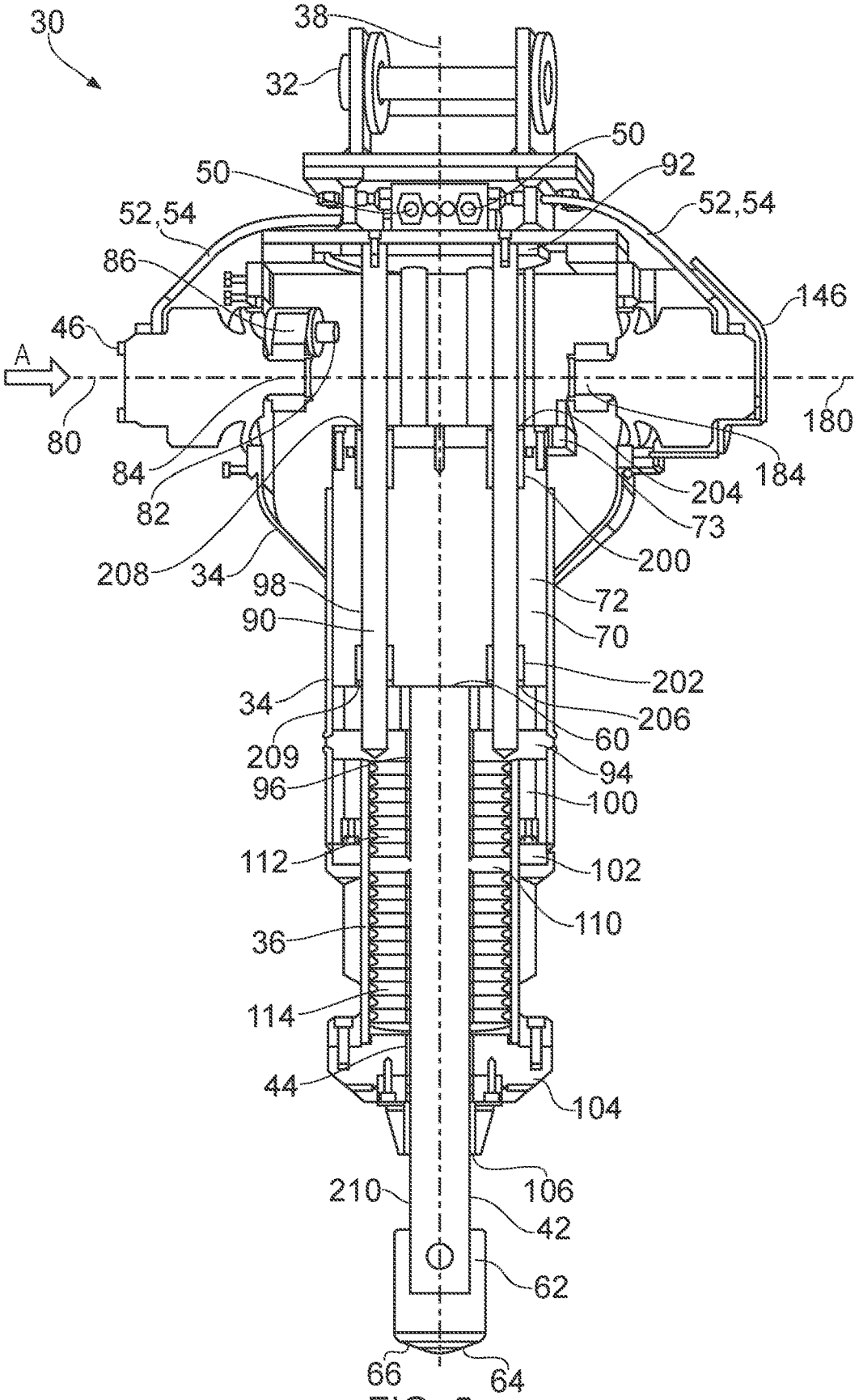
FIG. 5 shows a sectional view of an alternative arrangement to that shown in FIG. 4.
Figure 7:
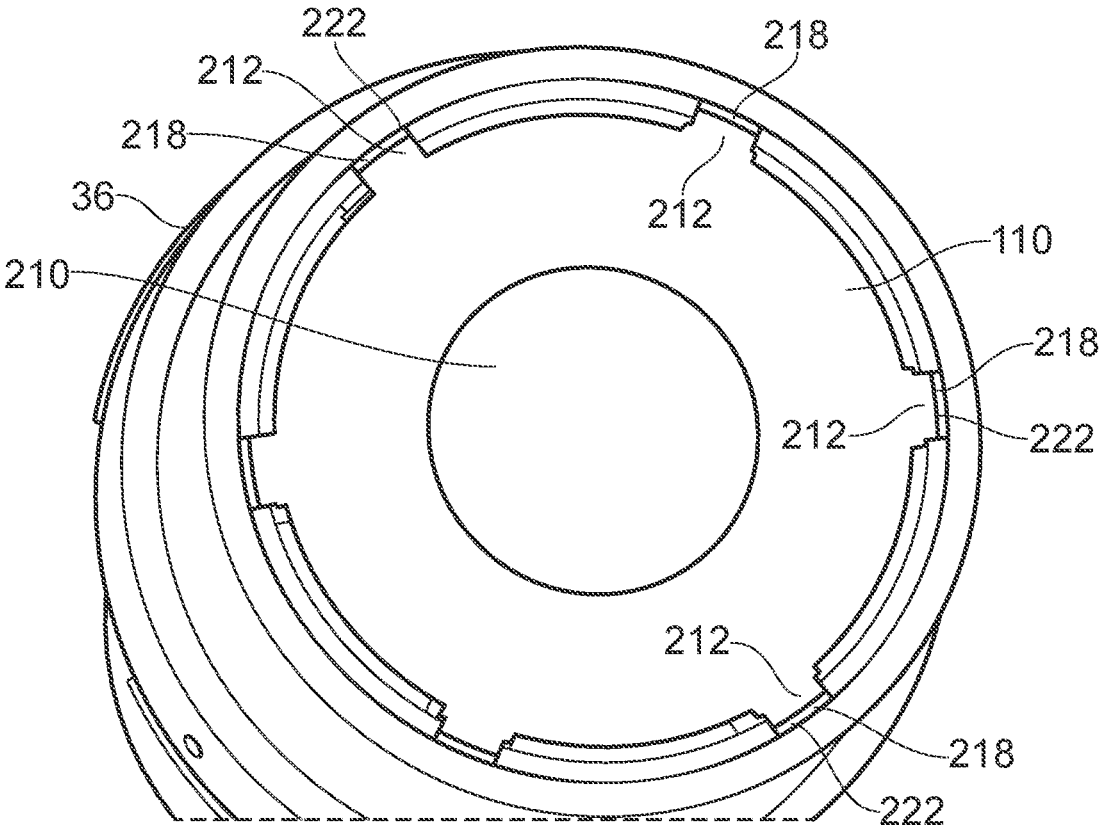
FIG. 7 shows a sectional view of the tool carrier shown in FIG. 6 located in a casing of the power tool of the present disclosure.
Figure 8:
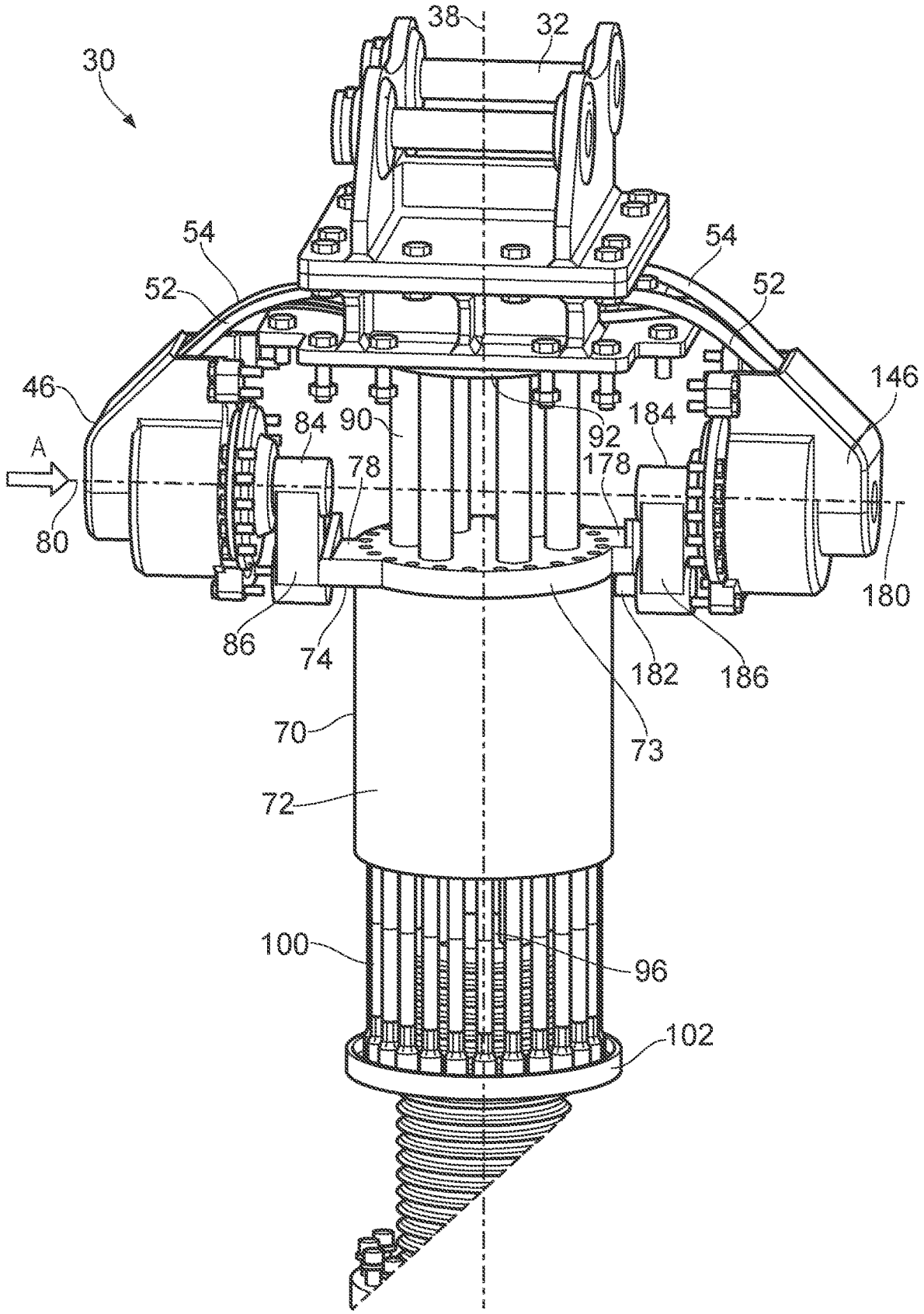
FIG. 8 shows internal components of the arrangement presented in FIG. 2.
Figure 9:
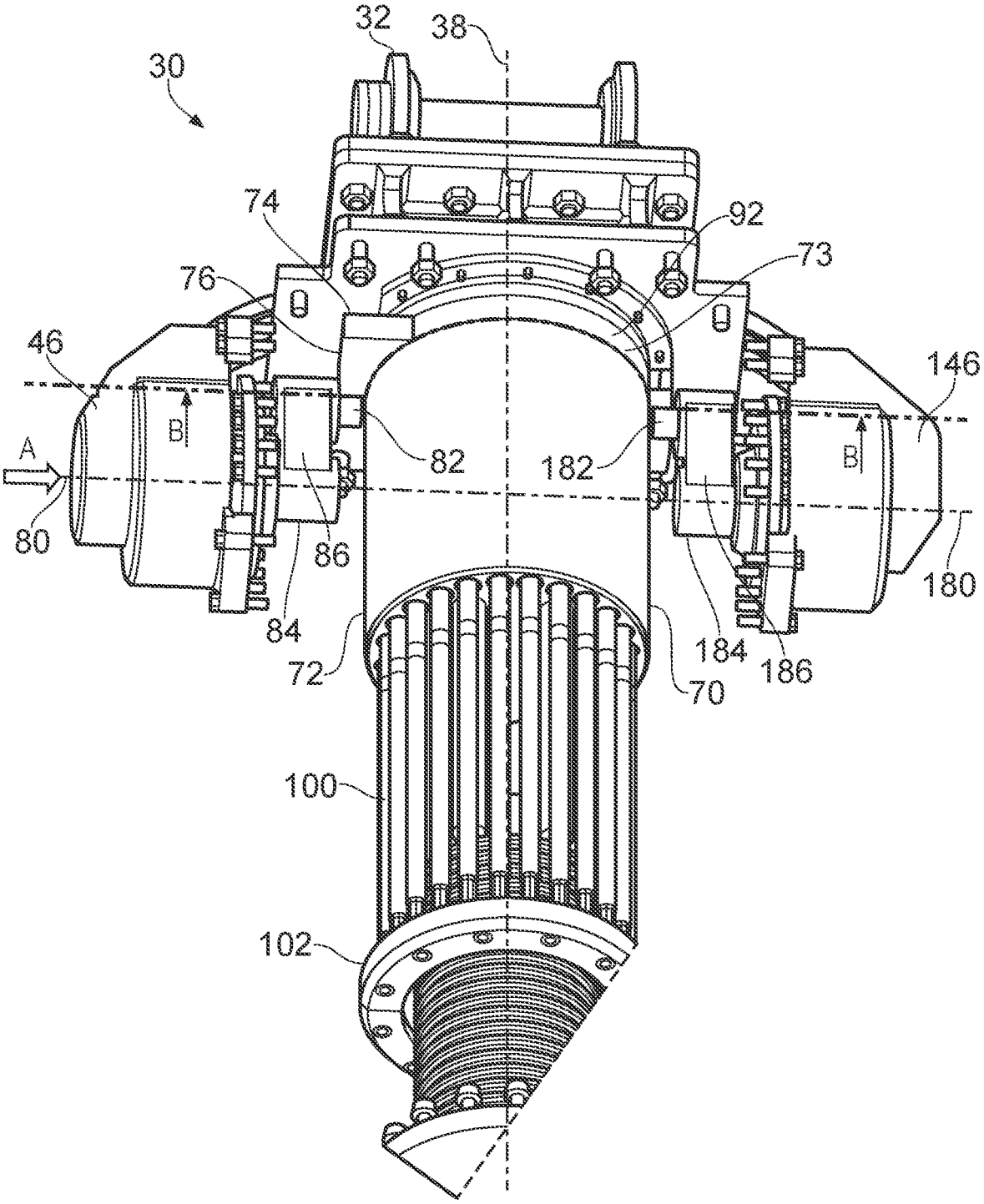
FIG. 9 shows the arrangement of FIG. 8 from a different angle and with the internal components in a different relative configuration.

FIGS. 2 and 3 show different views of the power tool when assembled according to the present disclosure. FIGS. 4, 5, 7 shows a sectional view of the arrangement shown in FIG. 2. FIGS. 8, 9 show different views of the power tool with outer casing elements removed for clarity to show detail of features of the device of the present disclosure.

The power tool 30 comprises a mount 32 so that the power tool 30 can be engaged with a carrier arm of a parent machine (for example a backhoe loader). It further comprises a first casing 34 and a second casing 36 spaced along the length of an operational axis 38. The operational axis 38 extends along the length of the power tool.

Although the body 70 and casings 34, 36 in the present example are shown as cylindrical, they could have a different cross-sectional shape, for example polygonal or square.

The power tool also comprises an impact tool 42 which is aligned with (i.e. centred on) the operational axis 38 and extends from an aperture 44 at an end of the second casing 36. Hence the operational axis 38 may substantially extend from the mount 32 to the end of the impact tool 42.

As shown in FIGS. 4, 5, 6, 7, the impact tool 42 comprises a head end 60. The impact tool 42 may be provided as a tool carrier 62 having a base member 210 aligned with the operational axis 38, the head end 60 of the impact tool 42 provided at one end of the base member 210 for receiving impact energy. The base member 210 comprises a foot end 64 at an opposite end of the impact tool 42 to the head end 60. At least part of the tool carrier 42 is located within the second casing 36.

Figure 6:
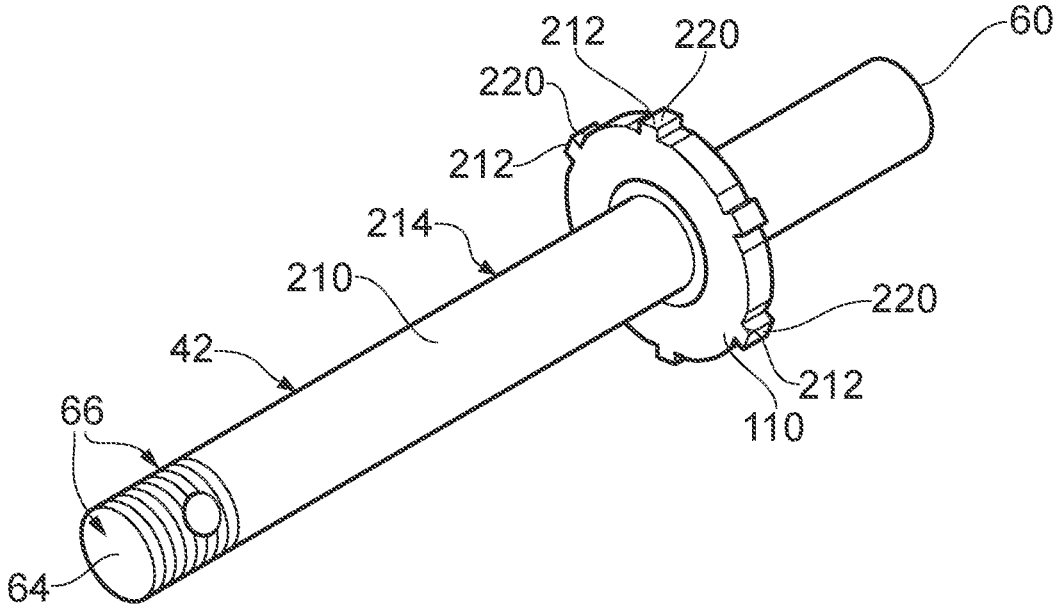
FIG. 6 shows tool carrier of the power tool of the present disclosure.

The impact tool 42 may further comprise a casing engagement feature 212 provided between the head end 60 and foot end 64. This is best shown in FIGS. 6, 7.

The second casing 36 is provided with a tool carrier engagement feature 218 complementary in shape to, and for interlocking engagement with, the tool carrier casing engagement feature 212 to thereby prevent rotation of the tool carrier 42 relative to the second casing 36 and around the operational axis 38, and permit relative movement between the tool carrier 42 and the second casing 36 along the operational axis 38. The tool carrier casing engagement feature 212 may comprise a lug 220 which extends longitudinally along part of the length of the tool carrier base member 210 such that, in use, the lug 220 is aligned with (i.e. extends parallel to) the operational axis 38 of the power tool 30.

The second casing engagement feature 218 is provided as a groove 222 in the inner surface second casing 36, the groove 222 configured to receive the lug 220 of the tool carrier casing engagement feature 212. The groove 220 is aligned with (i.e. extends parallel to) the operational axis 38 of the power tool 30, and is configured to permit the tool carrier 42 to move relative to the casing 36 along the operational axis 38.

The casing engagement feature 212 may comprise a plurality of lugs 220. The tool carrier engagement feature 218 may comprise a plurality of grooves 222. In the examples shown there are provided six lugs 220 and six grooves 222.

Figure 19:
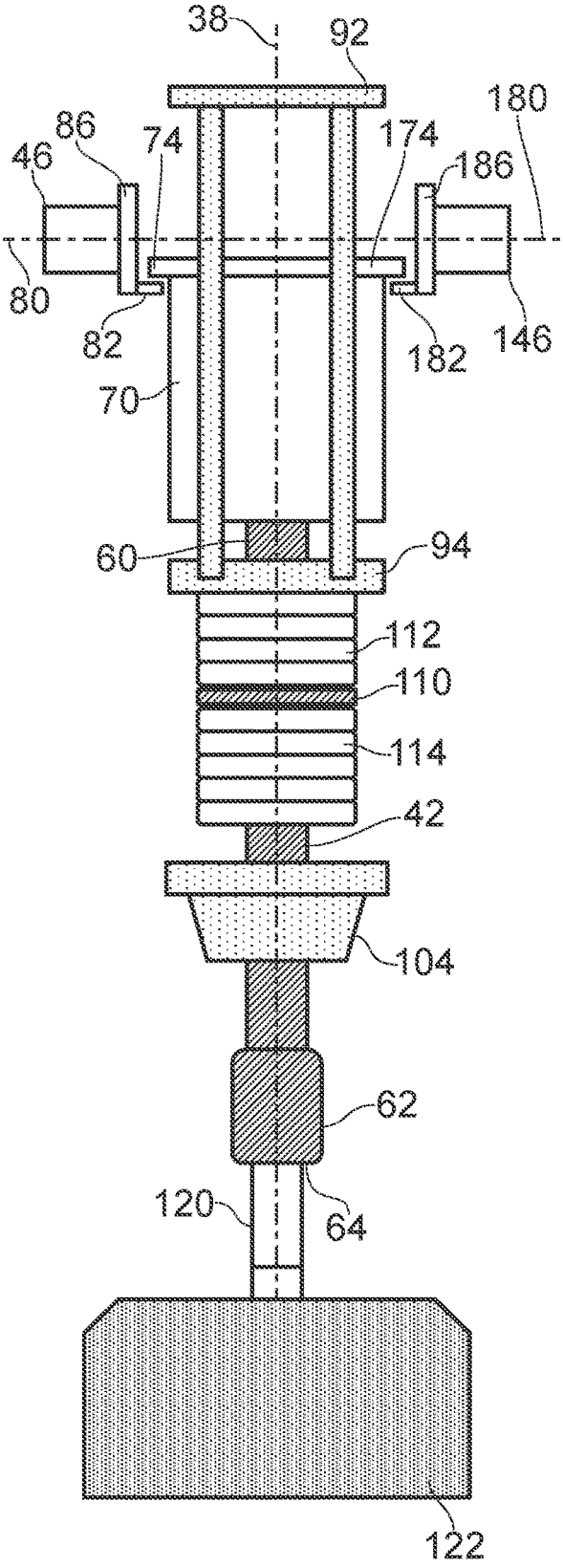
FIG. 19 shows internal components of the power tool of the present disclosure in an "impact" configuration.
Figure 20:
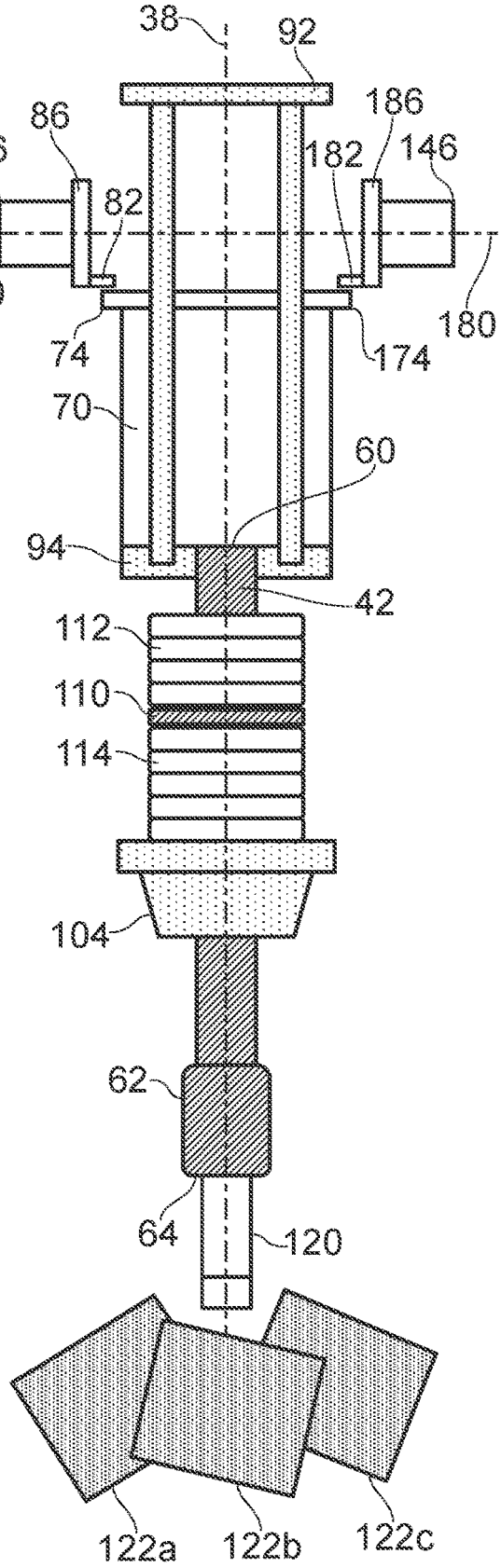
FIG. 20 shows internal components of the power tool of the present disclosure in a "rest" configuration.
Figure 21A:
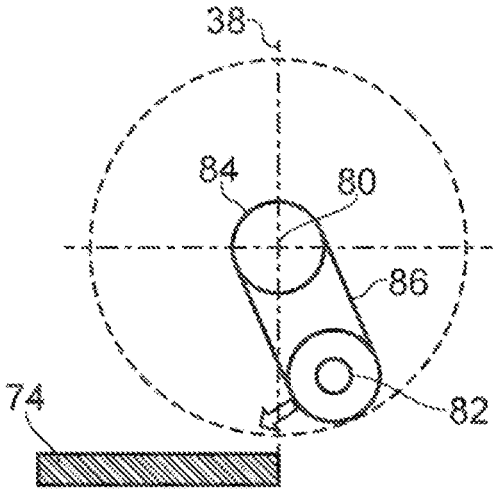
FIGS. 21A, 21B, 22A, 22B, 23A and 23B show the operation of an actuator and body according to the present disclosure when in the "rest" configuration shown in FIG. 20.
Figure 21B:
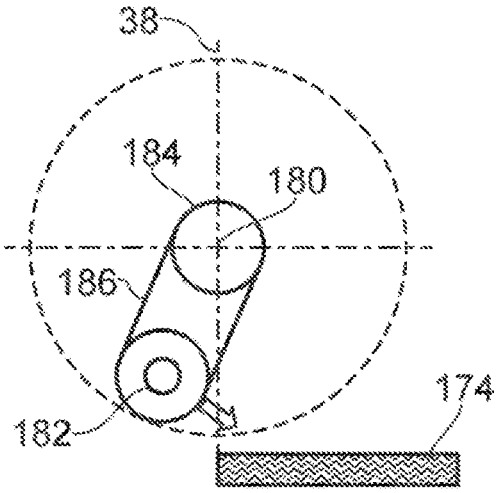
Figure 22A:
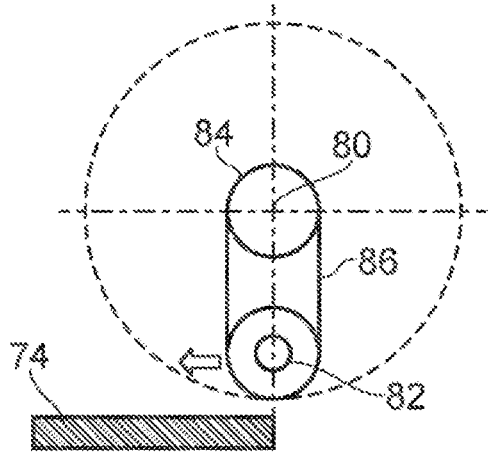
Figure 22B:
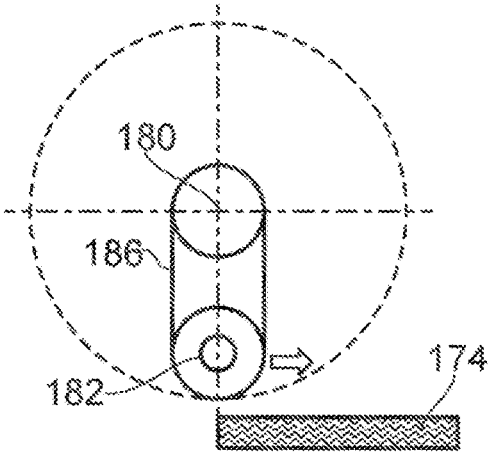
Figure 23A:
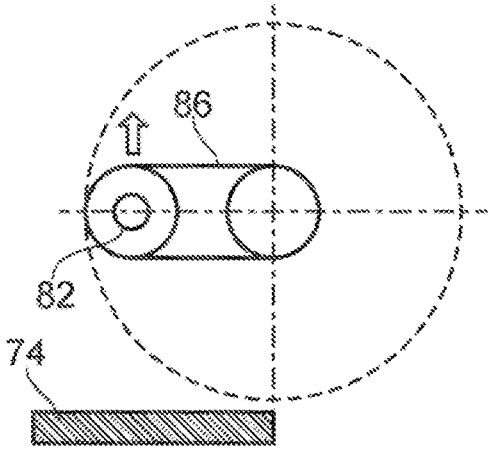
Figure 23B:
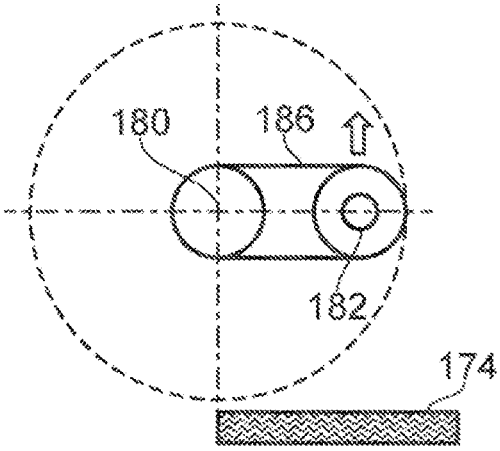

The foot end 64 may be provided with a tool mount 66 configured to transmit an impact energy created by the power tool to a tool 120 connected thereto (not shown in FIG. 4, illustrated in FIGS. 19, 20). Hence the impact tool 42 may comprise a tool carrier 66 for mounting an impact tool 120 along the operational axis 38. Alternatively the impact tool 42 may comprise an integral cutting tool.

The power tool further comprises a first actuator 46. The first actuator 46 may be mounted to the first casing 34. In the example shown there is also provided a second actuator 146 mounted diametrically opposite the first actuator 46. The second actuator 146 may be mounted to the first casing 34. In other examples the power tool of the present disclosure may be provided with a single actuator, or three or more actuators.

The first actuator 46 may be operable to be hydraulically actuated. Each of the actuators 46, 146 may be operable to be hydraulically actuated.

In the example shown the first actuator 46 and second actuator 146 are operable to be hydraulically actuated. Each of the first actuator 46 and second actuator 146 comprise a fluid coupling 50 for fluid communication with a fluid supply to drive the actuators 46, 146. The fluid supply may be provided as a source of hydraulic fluid provided under pressure by a parent vehicle which is coupled to the power tool 30.

The fluid coupling 50 is in fluid communication with the actuator 46, 146 via pairs of pipes 52, 54 which provide an inlet and outlet for the hydraulic fluid to thereby provide a flow of hydraulic fluid through the respective actuators 46, 146. The fluid supply of the first actuator 46 and second actuator 146 are controllable such that the fluid supply pressure to both actuators 46, 146 is matched. That is to say the system is configured such that the fluid pressure supplied to both actuators 46, 146 is the same by virtue of the fluid supply of the first actuator 46 and second actuator 146 being in fluid communication with each other. Hence an increase in load on one actuator results in an increase in force applied by the other actuator.

Figures 11, 12:
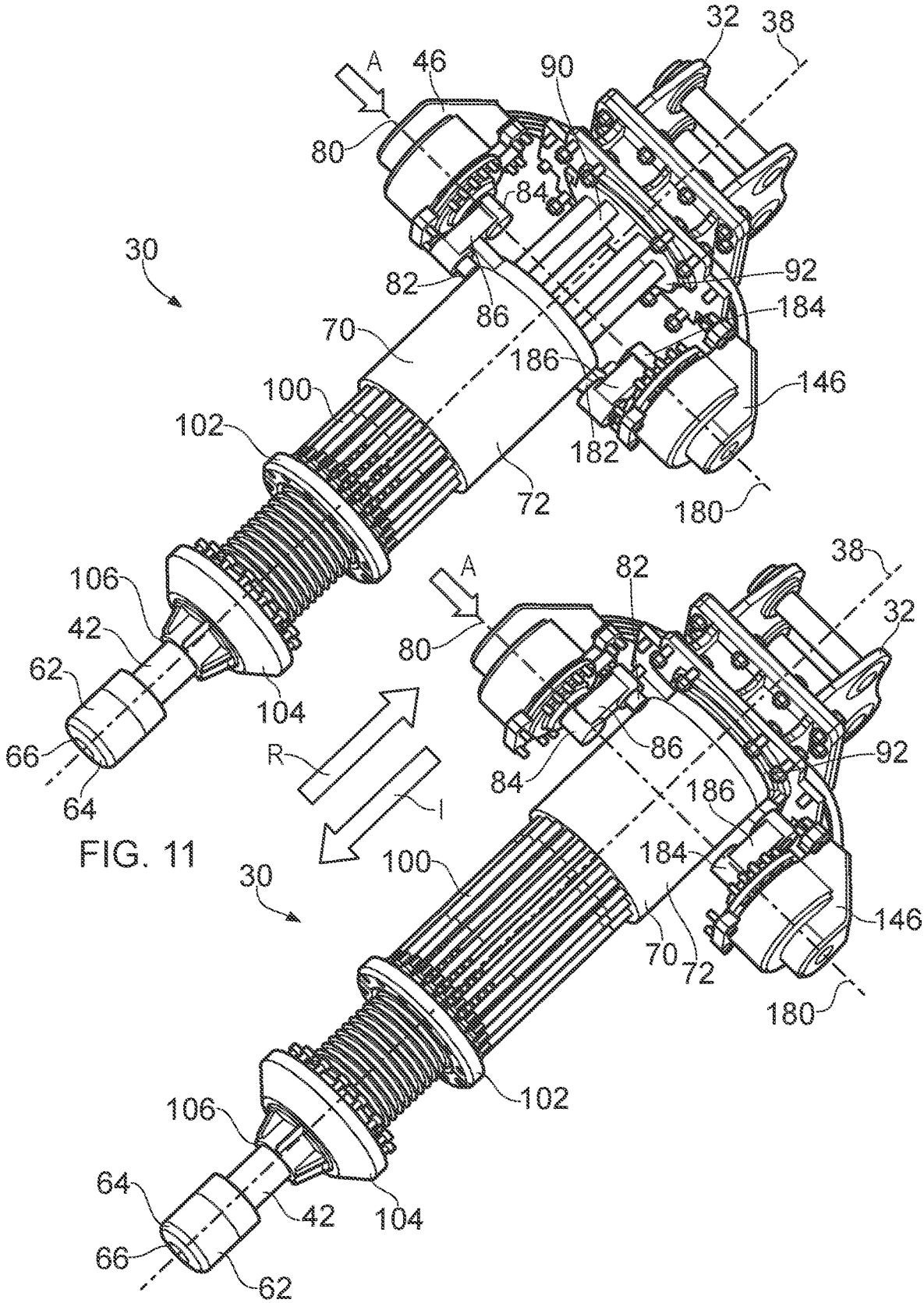
FIGS. 11 and 12 show the arrangement of FIGS. 8, 9 with components of the arrangement in different relative configurations.

Further details of the power tool of the present disclosure are shown in FIGS. 4 to 9. As shown in previous examples, the power tool 30 defines the operational axis 38. The power tool 30 further comprises a body 70 centred on the operational axis 38. The first actuator 46 is provided for moving the body 70 along the operational axis 38. It is operable to move the body 70 from an impact position at which the body 70 is operable to transfer impact energy to the head end 60 of the impact tool 42 (as shown in FIGS. 4, 5, 8) to a retracted position spaced apart from the impact position along the operational axis towards the mount 32 end of the power tool (as shown in FIGS. 9, 12).

As shown in FIG. 8, the body 70 comprises a main body portion 72 and a first flange 74 which extends away from the main body portion 72 in a direction away from the operational axis 38. The first flange 74 may be provided as part of a top plate 73 attached to the "top" of the body 70. As shown in FIG. 9 the first flange 74 comprises a first engagement land 76 which faces towards the impact position (i.e. towards the impact tool 42, away from the mount end 32). The first flange 76 has a first engagement edge 78 shown in FIG. 8, but hidden from view in FIG. 9, and also shown in FIGS. 13A, 13B, 14A, 14B, 15A, 15B, 16A, 16B, 17A, 17B, 18A, 18B, 21A, 21B, 22A, 22B, 23A and 23B.

As shown in FIG. 7, the first actuator 46 comprises a first actuator rotational axis 80. The first actuator rotational axis 80 may intersect the operational axis 38. The first actuator rotational axis 80 is provided at an angle to the operational axis 38. As shown in the figures, the first actuator rotational axis 80 may be provided perpendicular to the operational axis 38.

The first actuator 46 also comprises a first engagement member 82 offset from, and rotatable around, the first actuator rotational axis 80. The first actuator 46 further comprises a shaft 84 centred on and rotatable about the first actuator rotational axis 80. The first engagement member 82 is coupled to the first shaft 84 via an arm 86. Hence rotation of the shaft 84 about the rotational axis 80 rotates the first engagement member 82 around the first rotational axis 80. Put another way, the first engagement member 82 is coupled to the first shaft 84 and offset, by a fixed distance, from the first actuator rotational axis 80 so that the first engagement member 82 is rotatable around the first actuator rotational axis 80 to describe a (circular) path around the first actuator rotational axis 80.

The first engagement member 82 and first flange 74 are arranged relative to each other such that at the impact position the first engagement member 82 is operable to engage with the first flange engagement edge 78. The first engagement member 82 and first flange 74 are also arranged relative to each other such that as the first engagement member 82 rotates around the first actuator axis 80, the first engagement member 82 travels from the first flange engagement edge 78 along the first flange engagement land 76 and simultaneously urges the body 70 (by virtue of its connection to the first flange 74) in a direction away from the body impact position towards the body retracted position. The first engagement member 82 and first flange 74 are also arranged relative to each other such that at the retracted position the first engagement member 82 is operable to move past the first flange engagement edge 78 to thereby disengage the body 70 from the first engagement member 82, thereby permitting the body 70 to move on an impact stroke to the impact position.

In examples in which a second actuator 146 is provided, the body 70 further comprises a second flange 174 which extends away from a main body portion of the body 70 in a direction away from the operational axis 38. The second flange 174 may be provided as part of a top plate 73 attached to the "top" of the body 70. The second flange 174 comprises a second engagement land 176 which faces towards the impact position. The second flange 174 has a second engagement edge 178.

The second actuator 146 comprises a second actuator rotational axis 180. The second actuator rotational axis 180 may intersect the operational axis 38. The second actuator rotational axis 180 is provided at an angle to the operational axis 38. As shown in the figures, the second actuator rotational axis 180 may be provided perpendicular to the operational axis 38.

The second actuator 146 also comprises a second engagement member 182 offset from, and rotatable around, the second actuator rotational axis 180. The second actuator 146 also comprises a second shaft 184 rotatable around the second rotational axis 180. In the example shown, the second actuator rotational axis 180 is aligned with the first actuator rotational axis 80.

The second actuator rotational axis 180 may be collinear with the first actuator rotational axis 80. The second actuator rotational axis 180 may be co-axial with the first actuator rotational axis 80.

The second engagement member 182 is coupled to the second shaft via an arm 186 and offset by a fixed distance from the second actuator rotational axis 180 so that the second engagement member 182 is rotatable to describe a (circular) path around the second actuator rotational axis 180.

In the example shown the first engagement member 82 is provided on a first member 86, provided as an arm 86, which extends from the first shaft 84, and the second engagement member 182 is provided on a second member 186, provided as an arm 186, which extends from the second shaft 184. In alternative examples the first member 86 and second member 186 may be provided as a plate or disc or other member which supports the first engagement member 82 and/or second engagement member 182 offset from the rotational axis of their respective actuators 46, 146.

The second engagement member 182 and second flange 174 are arranged relative to each other such that at the impact position the second engagement member 182 is operable to engage with the second flange engagement edge 178. The second engagement member and second flange are also arranged relative to each other such that as the second engagement member 182 rotates around the second actuator rotational axis 180, the second engagement member 182 travels from the second flange engagement edge 178 along the second flange engagement land 176 and simultaneously urges the body 70 in a direction away from the body impact position towards the body retracted position. The second engagement member 182 and second flange 174 are also arranged relative to each other such that at the retracted position the second engagement member 182 is operable to move past the second flange engagement edge 178 to thereby disengage the body 70 from the second engagement member 182, thereby permitting the body 70 to move on an impact stroke to the impact position.

In examples in which a second actuator 146 is provided, the first engagement member 82 and second engagement member 182 may be operable to rotate in opposite directions relative to one another about their respective actuator axes 80, 180 when viewed along an axis aligned with the first rotational axis 80 and/or second rotational axis 180 (e.g. the direction indicated by arrow A in FIGS. 2, 4, 5, 8 to 11).

The first engagement member 82 and second engagement member 182, by virtue of their coupling to the actuators 46, 146 respectively, are controllable (i.e. operable) such that the first engagement member 82 engages with the first flange engagement edge 78 at the same instant as the second engagement member 182 engages with the second flange engagement edge 178, so both the first engagement member 82 and the second engagement member 182 engage with their respective flanges 74, 174 at the same time. The actuators 46, 146 are also controllable (i.e. operable) such that the first engagement member 82 passes the first flange engagement edge 78 at the same instant as the second engagement member 182 passes the second flange engagement edge 178 so both the first engagement member 82 and second engagement member 182 disengage from their respective flanges 74, 174 at the same time.

The first engagement land 76 may be the same length as the second engagement land 176. The actuator 46 and actuator 146 may be operable to rotate their respective first shaft 84 and second shaft 184 about their respective actuator axes 80, 180 at the same angular speed at a given instant in time. That is to say, the actuator 46 and actuator 146 may be operable to rotate their respective first shaft 84 and second shaft 184 about their respective actuator axes 80, 180 with the same velocity profile, where the velocity may be dependent on angular position.

The first engagement member 82 and, in examples where provided, the second engagement member 182 may each comprise a freely rotatable roller. That is to say, the first engagement member 82 and/or second engagement member 182 may comprise a rotatable member carried on a bearing such that as it moves along the engagement land it rotates, thereby reducing wear on the engagement land and its own bearing/outer surface.

Figure 10:
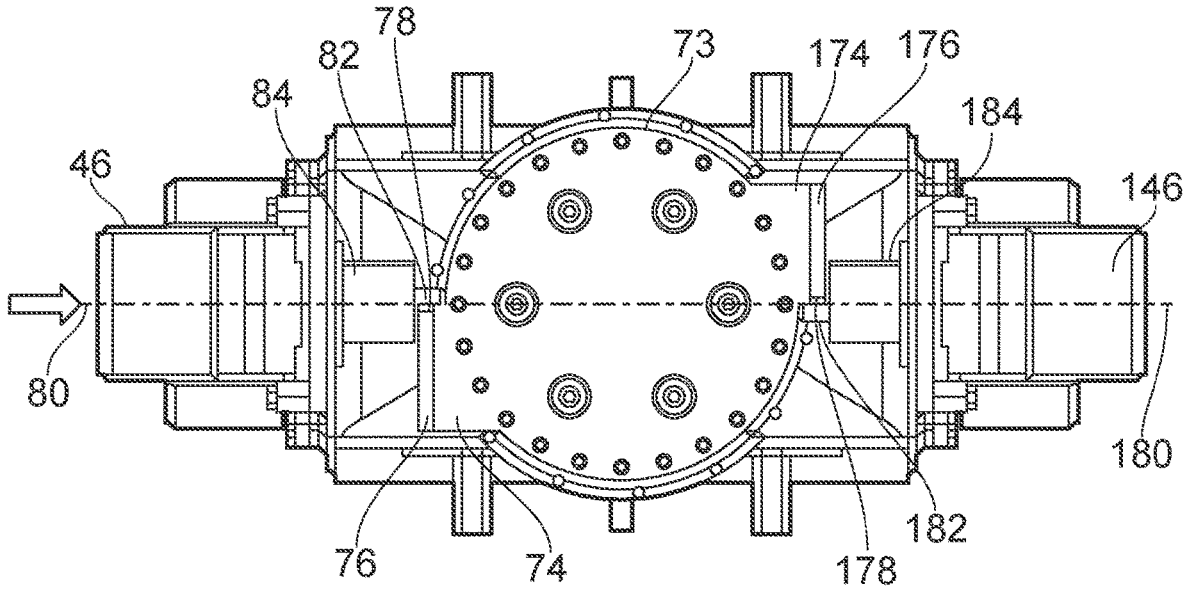
FIG. 10 shows a view along the section line BB shown in FIG. 9.

As shown in FIG. 10, the first engagement edge 78 may be aligned with the first actuator rotational axis 80. That is to say the first engagement edge 78 may be aligned with a plane that extends through the operational axis 38 and first actuator rotational axis 80. For example, a plane defined by the operational axis 38 and first actuator rotational axis 80 is coplanar with a surface 79 of the first engagement edge 78.

In examples in which a second actuator 146 is provided, the second engagement edge 178 may be aligned with the second actuator rotational axis 180. That is to say the second engagement edge 178 may be aligned with a plane that extends through the operational axis 38 and second actuator rotational axis 180. For example, a plane defined by the operational axis 38 and second actuator rotational axis 180 is coplanar with a surface 179 of the second engagement edge 178.

The first flange engagement edge 78 may be aligned with the second flange engagement edge 178. The first actuator rotational axis 80 may be aligned with the second actuator rotational axis 180. That is to say both the first flange engagement edge 78 and the second flange engagement edge 178 may sit along a common axis which is defined by the first actuator rotational axis 80 and the second actuator rotational axis 180.

The first flange 74 extends away from the first flange engagement edge 78 along a side of the body 70 in a first direction away from the first actuator rotational axis 80. The second flange 174 extends away from the second flange engagement edge 178 along a side of the body 70 in a second direction away from the second actuator rotational axis 182, the first direction being in an opposite direction to the second direction.

As shown in FIGS. 4, 5, 8 the power tool further comprises a plurality of rods 90 held in a fixed relationship to one another by a first mount 92 towards one end of the rods 90 towards the mounting end 32, and a second mount 94 spaced apart from the first mount 92 along the operational axis 38 towards an opposite end of the rods 90 towards the tool carrier 42 end of the power tool 30. The second mount 94 is provided with an aperture 96 through which the impact tool 42 extends. The rods 90 may be parallel to the operational axis 38. That is to say, the rods 90 may be aligned with, but spaced apart from, the operational axis 38. The rods 90 may be parallel to each other.

As shown in FIGS. 4, 5, the body 70 defines passages 98, each of the passages 98 accommodating one of the rods 90. The passages 98 are configured such that the body 70 may translate between the impact position and the retracted position along at least said rods 90.

The body 70 may be in slideable engagement with at least some of the rods 90, as shown in FIG. 4.

As shown in FIG. 5, a first bearing unit 200 may be provided in each of the passages 98, the first bearing unit 200 being configured to bear upon the rod 90 accommodated therein. A second bearing unit 202 may be provided in each of the passages 98, the second bearing unit 202 configured to bear upon the rod 90 accommodated therein, the second bearing unit spaced apart from the first bearing unit 202 along the length of the passage 98. Further bearing units may be provided in each of the passages 98, spaced apart from the other bearing units along the length of the passage 98.

As shown in FIG. 5, the first bearing unit 200 may be provided at, or close to, an entrance/opening 204 of its respective passage 98 and extend into the passage 98 therefrom (i.e. from the entrance 204, or from close to the entrance 204). Likewise, the second bearing unit 202 may be provided at, or close to, another entrance/opening 206 to the passage 98 on the opposite end of the body 70, and extend into the passage 98 therefrom (i.e. from the entrance 206, or from close to the entrance 206).

Alternatively the first bearing unit 200 may be provided along the passage 98 spaced apart from the entrance/opening 204. Likewise the second bearing unit 202 may be provided along the passage 98 spaced apart from the entrance/opening 206.

A first passage seal 208 may be provided between first bearing unit 200 and the entrance 204. A second passage seal 209 may be provided between the second bearing unit 202 and the second entrance/opening 206. The passage seals 208, 209 may be configured to seal between the body 70 and rods 90 to maintain a lubricant around and between bearing units 200, 202.

The bearing units 200, 202 may comprise low friction sleeves (or bushes) for sliding along the surface of the rods 90. Alternatively the bearing units may comprise ball bearing or roller bearings configured for low friction running on the surface of the rods 90. For example, the bearing units may axial bearings or thrust bearings. A clearance may be maintained between the passages 98 and the rods 90 such that only the bearing units 200, 202 extend between the body 70 and rods 90.

Examples in which two or more bearing units are provided are especially advantageous as they resist any misalignment of the body 70 on the rods 90 due to forces induced on the body by the actuator 46 in examples in which only one actuator 46 is provided.

That is to say, examples in which two or more bearing units are provided are especially advantageous as they resist any couple induced on the body 70 by the actuator 46 in examples in which only one actuator 46 is provided, and hence allow for the body 70 to travel along the rods 90 freely, with minimum of frictional resistance and wear.

The bearing units also resist any misalignment of the body 70 on the rods 90, and hence minimise frictional resistance and wear due to forces induced on the body by both actuators 46, 146, when two actuators are provided.

The body 70 may define passages 98 in slidable engagement with at least some of the rods 90, the passages 98 configured such that the body 70 may translate between the impact position and the retracted position along at least some of the rods 90. This arrangement may be configured to resist any couple induced on the body 70 by the actuator 46 in examples in which only one actuator 46 is provided, or two or more actuators is provided, and hence allow for the body 70 to travel along the rods 90 freely, with minimum of frictional resistance and wear.

Low friction surfaces and/or coatings on the passages and/or rods may be provided to reduce frictional resistance induced by a couple induced on the body 70 in a single or multiple actuator arrangement.

As shown in FIGS. 8, 9, 11, 12 one end of an array of elastic ropes 100 is coupled to the body 70, and another end of the elastic ropes is coupled to a third mount 102. The third mount 102 is spaced apart from the second mount 94 in a direction away from the first mount 92.

Hence the third mount 102 may be provided spaced apart from the second mount 94 in a direction along the operational axis 38 such that the third mount 102 faces one side of the second mount 94, and the first mount faces an opposing side of the second mount 94.

The ropes 100 pass through apertures, or spaces, provided in the second mount 94 and are mounted to the third mount 102, rather than the second mount 94, in order to provide contraction spaces for the ropes 100.

The array of ropes 100 may comprise any number of elastic ropes, depending on their length, diameter and the material from which they are made, although the amount of energy that can be stored and released increases with the number of elastic ropes. The power tool 30 of the present example is provided with 24 elastic ropes.

The array of ropes 100 is coupled to the body 70 and are configured such that the body 70 may translate from the impact position to the retracted position (as shown in FIGS. 9, 12) in a retraction direction along its carrying rods 90 under the action of the actuators 46, 146 against the force developed by the elastic ropes 100. The retraction direction is shown by arrow "R" in FIG. 12. The array of elastic ropes are also configured such that the body 70 is biased to move in an impact direction along at least some of the rods 90 towards its impact position (as shown in FIGS. 4, 8, 11) from its retracted position by the elastic ropes while uncoupled from the actuators 46, 146. The impact direction is shown by arrow "I" in FIG. 12.

The first casing 34 may extend between the first mount 92 and the second mount 94 and/or the third mount 102. The second casing 36 may extend from the second and/or third mount 102 along the operational axis 38, the second casing 36 terminating in an end plate or hub 104, wherein the impact tool 42 extends out of an aperture 106 in the end hub 104, and the end plate/hub 104 closes the aperture 44 of the second casing 36.

A support land 110 extends from the impact tool 42 base member 210 part of the way between the head end 60 and the foot end 64. A first damping member 112 may be provided between the support land 110 and second mount 94, and a second damping member 114 may be provided between the support land 110 and the second casing end plate/hub 104.

The support land 110 may extend radially outwards from the tool carrier base member 210. The or each lug 220 may extend radially outwards from the support land 110. In examples in which a plurality of lugs 220 and grooves 222 are provided, the lugs 220 and grooves 222 may be equally spaced around the support land 110.

The elastic ropes 100 are located on a common pitch circle diameter and are provided outwards (for example radially outwards) of the rods 90.

The body 70 may be provided with a greater mass than the mass of the tool carrier 42 or a greater mass than the combined mass of the tool carrier 42 and resultant tool assembly (i.e. the tool carrier 42 holding a tool). The ropes may be coupled via a direct load transmission path to the third mount 102 and body 70.

In one example the combined mass of the body 70 (including flanges) may be about 725 kg.

The first damper 112 may comprise at least two damping members in series along the operational axis 38. The at least two damping members may have different stiffness to one another. The second damper 114 may also comprise a number of damping member and series, with different stiffness.

In use, shock loads will be high due to the energy being produced by the action of the actuators, body and ropes. The shock loads may be because of "blank fire", produced when the impact tool being used easily penetrates a material and the body 70 moves beyond its normal stopping point with the impact tool 42. In this scenario the body 70 will press the support land 110 into contact with the second damper 114, which absorbs the shock energy.

Alternatively the shock loads may be because of "recoil" which is produced when the impact tool 42 strikes hard material and a shock wave travels back up the impact tool 42 and rest of the body of the power tool 30. In this scenario the support land 110 is forced into contact with the first damper 112 which absorbs the shock load.

In both cases the configuration of the device of the present invention is beneficial as the arrangement of the first damper 112, second damper 114 and support land 110 is such as to reduce shock loads travelling into the structure of the power tool 30, and hence prevent shock loads being passed back through to a parent vehicle upon which the power tool 30 is mounted. This extends the life of the vehicle as well as reducing user (i.e. driver) discomfort.

FIGS. 13A, 13B, 14A, 14B, 15A, 15B, 16A, 16B, 17A, 17B, 18A and 18B show operation and interaction between the engagement members 82, 182 and their respective flanges 74, 174 on the body 70. FIGS. 13A, 14A, 15A, 16A, 17A and 18A relate to the first actuator 46, the first engagement member 82 and first flange 74. FIGS. 13B, 14B, 15B, 16B, 17B, and 18B relate to examples in which a second actuator 146, second engagement member 182 and second flange 174 are provided. Although the following description relates to an example comprising first and second actuators 46, 146, it is also applicable, at least in part, to the operation of an example comprising a single actuator 46.

Only features necessary to illustrate the interaction between the actuators 46, 146 and the flanges 74, 174 of the body 70 are shown, with the flanges 74, 174 being shown in isolation from the body 70 to which they are attached, and hence neither the rods 90 on which the body 70 is carried, nor the ropes 100, are shown. However the movement and interaction of these may be understood with reference to the referenced Figures.

As can be seen in FIGS. 13 to 18, the shafts 84, 184 of the first and second actuators 46, 146 respectively rotate in different directions, powered to move by a flow of pressurised hydraulic fluid provided from the fluid source.

The power tool 30 of the present disclosure is intended to be powered by conventional auxiliary "hammer" circuits found on a conventional excavator (e.g. a backhoe loader). The required flow rate may be about 250 litres per minute at a pressure of about 145 bar, which is similar to that of a conventional device, and thus the device of the present application will be compatible with existing systems. Such flow and pressure may achieve a blow rate of 60 blows per minute (bpm).

The frequency may be altered by reconfiguring the actuator, for example by altering cam profiles within each actuator.

The representations shown in FIGS. 13A, 13B, 14A, 14B, 15A, 15B, 16A, 16B, 17A, 17B, 18A and 18B are as viewed from the viewpoint indicated by arrow "A" along the common axis defined by the first rotational axis 80 and second rotational axis 180 of the actuators 46, 146.

In this example the first actuator 46 rotates in a clockwise direction and the second actuator 146 rotates in an anti-clockwise direction. In other examples the first actuator 46 may rotate in an anti-clockwise direction and the second actuator 146 may rotate in a clockwise direction. In other examples the first actuator 46 and the second actuator 146 may rotate in the same direction.

Figure 13A:
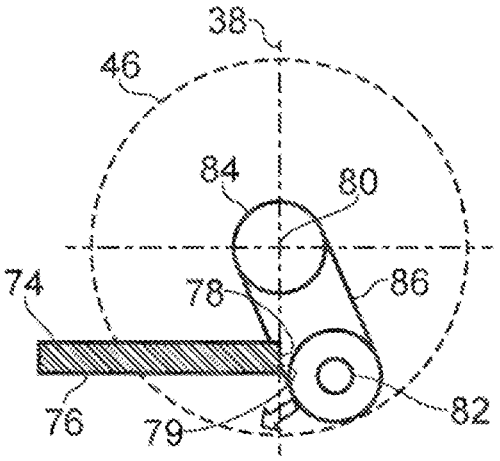
FIGS. 13A, 13B, 14A, 14B, 15A, 15B, 16A, 16B, 17A, 17B, 18A and 18B show the operation of a "catch and release" interface of an actuator and body according to the present disclosure.
Figure 13B:
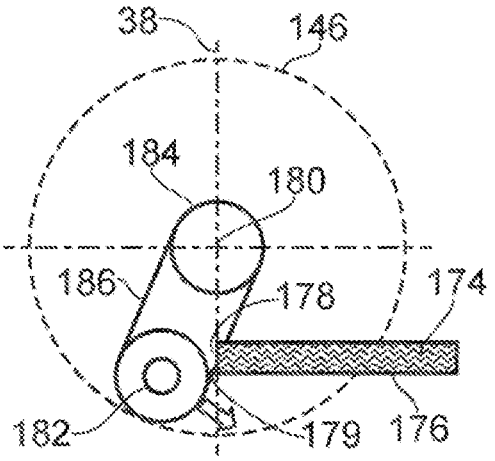

FIGS. 13A and 13B show the flanges 74, 174 (attached to the body 70) when the body 70 is in the impact position, that is to say sat on top of the head end 60 of the impact tool 42 (as shown in FIGS. 4, 5, 8, 11). In this example the impact tool 42 (e.g. with a cutting tool attached to the mount 66) is in contact with a material to be machined (as shown in FIG. 19), and hence the impact tool 42 is retracted into the casing of the power tool at most as far as allowed by the first damper 112. Put another way, because the shoulder 110 of the impact tool 42 will press into contact with the first damper 112, the impact tool 42 may retract into the second casing 36 as far as allowed by the thickness of the first damper 112. Consequently, the body 70 is pushed by the head end 60 of the impact tool to a given position on the rods 90. In this position, the flanges 74, 174 are in position where they may be engaged by the engagement members 82, 182.

FIGS. 13A and 13B show such an example, in which the shafts 84, 184 are shown to be moving to bring the engagement members 82, 182 towards bottom dead centre (BDC) and hence towards the respective engagement edges 78, 178 of the flanges 74, 174.

Figure 14A:
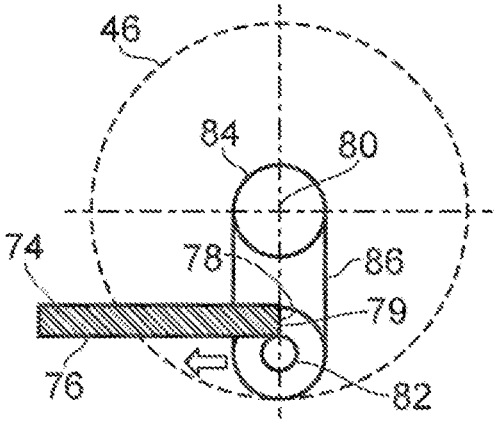
Figure 14B:
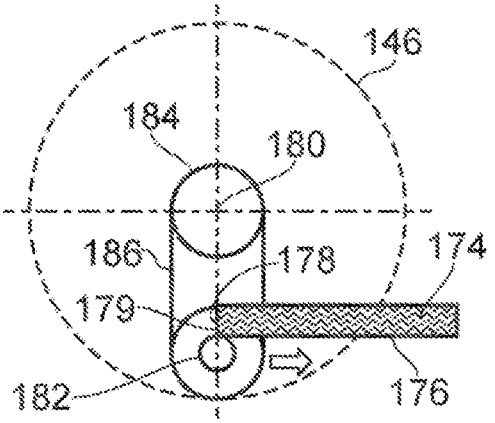

In FIGS. 14A and 14B, the engagement members 82, 182 are shown having just engaged with their respective flanges 74, 174 at their respective flange engagement edges 78, 178. The actuators 46, 146 are controlled to ensure that the engagement members 82, 182 engage with their respective flange engagement edges 78, 178 at the same instant. However if there is a difference between the positions (i.e. a lag) between the first shaft 84 and second shaft 184 then, because the fluid supply between the actuators 46, 146 is connected, and therefore balanced/matched, the actuator of the lagging engagement member 82, 182 will be subject to an increased force due to the increased load on the other (i.e. the leading) one of the engagement members 82, 182. Hence the arrangement will inherently correct any lag which occurs in the angular positions of the engagement members 82, 182.

Figure 15A:
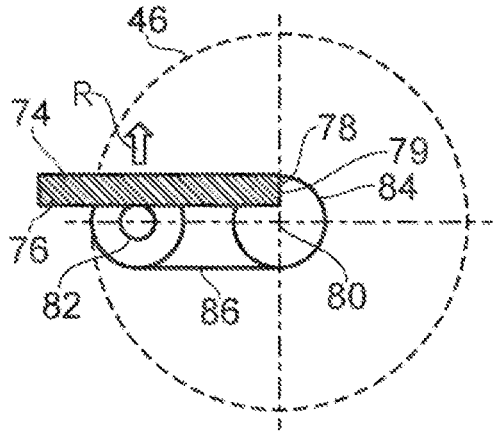
Figure 15B:
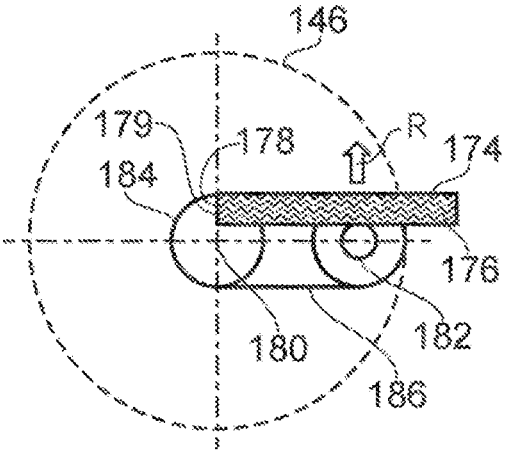

Having engaged with the flange engagement edge 78, 178 the respective engagement member 82, 182 travels along the respective flange engagement land 76, 176 as the actuators 46, 146 rotate the shafts 84, 184 and hence move the angular position of the engagement members 82, 182 to lift the flanges 74, 174 and hence urge/move the body 70 in a direction away from the body impact position (as shown in FIGS. 4, 5, 8 and 11) towards the body retracted position (that is to say to move the body in the retraction direction "R", as shown in FIGS. 12, 15A, 15B).

Until halfway between bottom dead centre and top dead centre (TDC) (as indicated in FIGS. 15A, 15B) the engagement members 82, 182 move away from the flange engagement edge 78, 178 along the engagement land 76, 176. As the engagement members 82, 182 continue towards top dead centre, the shafts 84, 184 continue to turn and hence continue to lift the flanges 74, 174 (and hence body 70) in the retraction direction "R". Halfway between bottom dead centre and top dead centre the engagement members 82, 182 reverse course and move back along the engagement land 76, 176 towards the flange engagement edge 78, 178.

Figure 16A:
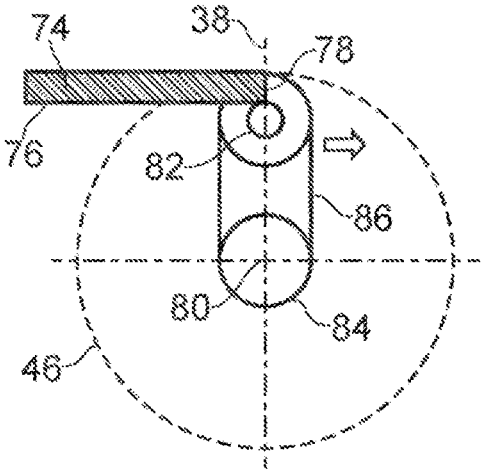
Figure 16B:
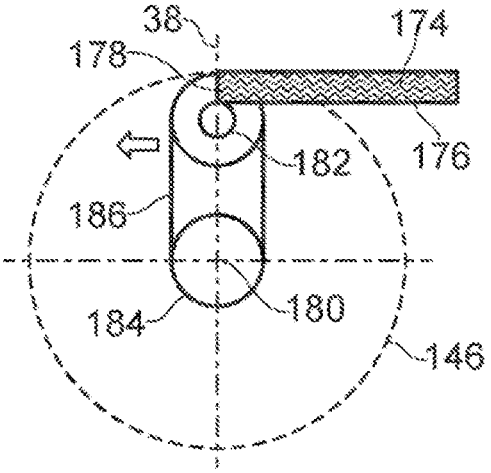

At top dead centre (TDC), or shortly thereafter, as shown in FIGS. 16A and 16B, which corresponds to the retracted position as shown in FIGS. 9, 12, the engagement member 82, 182 reaches the flange engagement edge 78, 178. Hence to reach this point, the body 70 has been translated from the impact position to the retracted position in the retraction direction "R" along its carrying rods 90 under the action of the actuator 46, 146 and against a force developed by the elastic ropes 100.

Figure 17A:
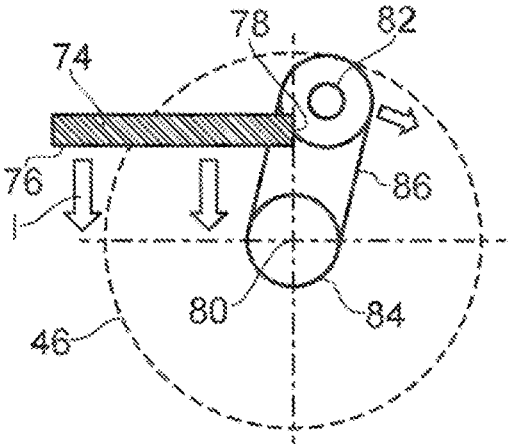
Figure 17B:
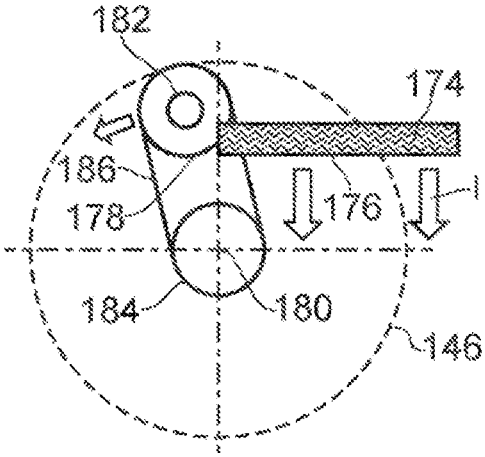

The actuators 46, 146 continue to turn the engagement members 82, 182 so that the engagement members 82, 182 then move past the flange engagement edge 78, 178 to thereby disengage the body 70 from the engagement members 82, 182, as shown in FIGS. 17A and 17B. This permits the body 70 to move in an impact stroke, in the impact direction "I", to the impact position, as shown in FIGS. 17A and 17B. Hence released/uncoupled from the actuators, and because the body 70 is biased to move in the impact direction "I" by the ropes 100, the body then moves from the retracted position along the rods 90 upon which it is carried towards its impact position by the elastic ropes 100.

Figure 18A:
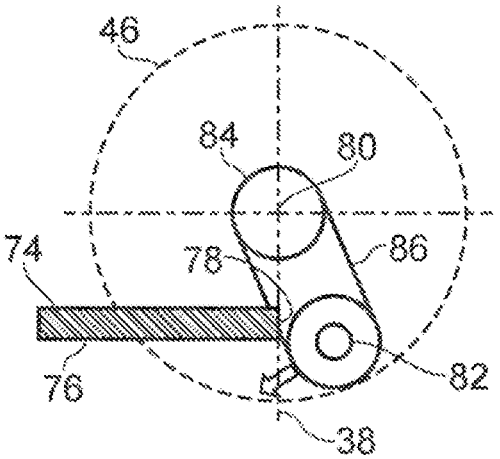
Figure 18B:
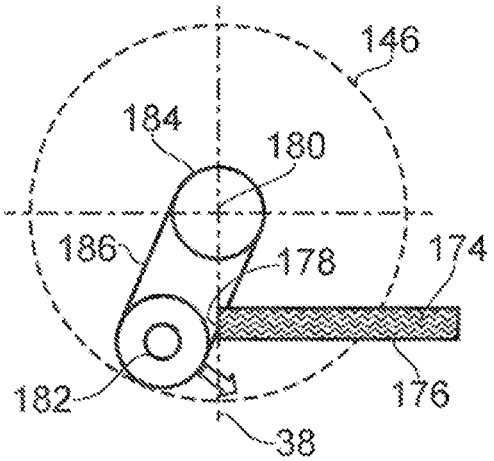

Since the engagement members 82, 182 are unloaded at this point in the cycle, they rotate around to bottom dead centre (BDC) position, as shown in FIGS. 18A and 18B, towards engaging with the flange engagement edge 78, 178, and as shown in FIGS. 13A and 13B, thereby starting the cycle again.

Hence the actuators are operable to continually rotate the engagement members 82, 182 around their respective rotational axes 80, 180 to engage with the flange 74, 174, and hence move the body 70 to a retracted position, and then release the flange 74, 174 to allow the body 70 to move to an impact position, and to repeat the cycle as required.

Although the angular speed of the actuators 46, 146 and the engagement members 82, 182 may not be constant, they will continually rotate in the same direction.

FIG. 19 shows the relative spacing of the actuators 46, 146 and their respective flanges 74, 174 when the impact tool 42 is in the impact position. That is to say, when a tool 120 is mounted in the tool carrier 62 of the impact tool 42 and is in contact with a target object 122, or (not shown) when a cutting part of the impact tool 42 is in contact with the target object 122, then the head end 60 of the impact tool 42 forces/urges the body 70 to the impact position in which the engagement members 82, 182 can engage and disengage with the flanges 74, 174 as described above.

However, should no load be applied to the impact tool 42 (for example the power tool is lifted away from a target material so the impact tool is not in contact with a material, or as shown in FIG. 20, because the target object has broken and fallen away from the tool 120 and/or cutting part of the impact tool 42) then the impact tool 42 may extend further from the end of the power tool 30 casing, and hence the body 70 may be drawn closer to the second mount 94, and hence further away from the reach of the engagement members 82, 182. In this position (named the "rest position") the flanges 74, 174 are too far away from the engagement members 82, 182 to be engaged by them, and the engagement members 82, 182 are rotatable around their axis 80, 180 by the actuators 46, 146 without making contact with (i.e. without engagement with) the flanges 74, 174 of the body 70.

Thus the retracted position, impact position and rest position of the body 70 are spaced along the operational axis 38 in series, with the impact position located between the retracted position and the rest position. The distance between the retracted position and the impact position may be greater than the distance between the impact position and the rest position.

FIGS. 21A, 21B, 22A, 22B, 23A and 23B show operation and interaction between the engagement members 82, 182 and their respective flanges 74, 174 on the body 70 in the mode of operation shown in FIG. 20 when the body is in the rest position. Although the following description relates to an example comprising first and second actuators 46, 146, it is also applicable, at least in part, to the operation of an example comprising a single actuator 46.

The actuators 46, 146 operate as before to move the engagement members 82, 182 around their respective rotational axes 80, 180. However, with the body 70 in the rest position, spaced apart from the impact position along the operational axis 38 towards the second mount 94, a clearance is maintained between the flanges 74, 174 and the engagement members 82, 182.

Hence while the body 70 is in the rest position, it is not engageable by the engagement members 82, 182, and hence will be free of the actuators 46, 146, and hence will not be drawn by the actuators 46, 146 to the retracted position.

This reduces unnecessary vibrations and wear on the power tool, as well as providing a safety feature e.g. if no load is applied to the impact tool 42, then no impact load will be applied to the impact tool 42.

As soon as the cutting part of the impact tool 42 (e.g. cutting tool 120) is placed in contact with a target 122, then the body 70 will be urged back to the impact position (shown in FIG. 19) by virtue of its connection with the head end 60 of the impact tool 42. That is to say, the body 70 is operable to travel along the operational axis 38 between the impact position and the rest position, wherein at the rest position the first engagement member 82 is spaced apart from the first flange 74 as the first engagement member 82 rotates about the first rotational axis 80. Additionally, at the rest position the second engagement member 182 is spaced apart from the second flange 74 as the second engagement member 182 rotates about the second rotational axis 180. Put another way, the body 70 is operable to travel along the operational axis 38 between the impact position and the rest position, wherein at the rest position the first engagement member 82 is spaced apart from the first flange 74 in the direction of the operational axis 38 as the first engagement member 82 rotates about the first rotational axis 80. Additionally, at the rest position the second engagement member 182 is spaced apart from the second flange 74 in the direction of the operational axis 38 as the second engagement member 182 rotates about the second rotational axis 180.

Hence the impact tool 42 is operable to travel along the operational axis 38 between the impact position at which the head end 60 of the impact tool 42 is a first distance (X) from the actuator rotational axis 80, 180, and the rest position in which the head end 60 of the impact tool 42 is a second distance (Y) from the actuator rotational axis 80, 180, the second distance (Y) being greater than the first distance (X). The first engagement member 82 and first flange 74 are arranged relative to each such that when the impact tool 42 is in the rest position the first engagement member 82 is spaced apart from the first flange 74 as it rotates about the first actuator rotational axis 80. Additionally when the impact tool 42 is in the rest position the second engagement member 182 is spaced apart from the second flange 174 as it rotates about the second actuator rotational axis 180.

A device of the present disclosure is thus advantageous since it comprises a simpler actuation mechanism than examples of the related art, the present invention employing constantly rotating actuators 46, 146 to catch/engage with and release the body 70 which provides an impact load to the impact tool 42. This provides a more constant load on the hydraulic supply to which it is attached, as well as being inherently easier to control, maintain and manufacture than examples of the related art.

Additionally the cyclic speed of impulse delivery (i.e. the rate at which the body 70 is retracted and released to provide an impact load) may be tuned to a specific requirement, which is considerably harder to achieve with examples of the related art.

Figure 1:
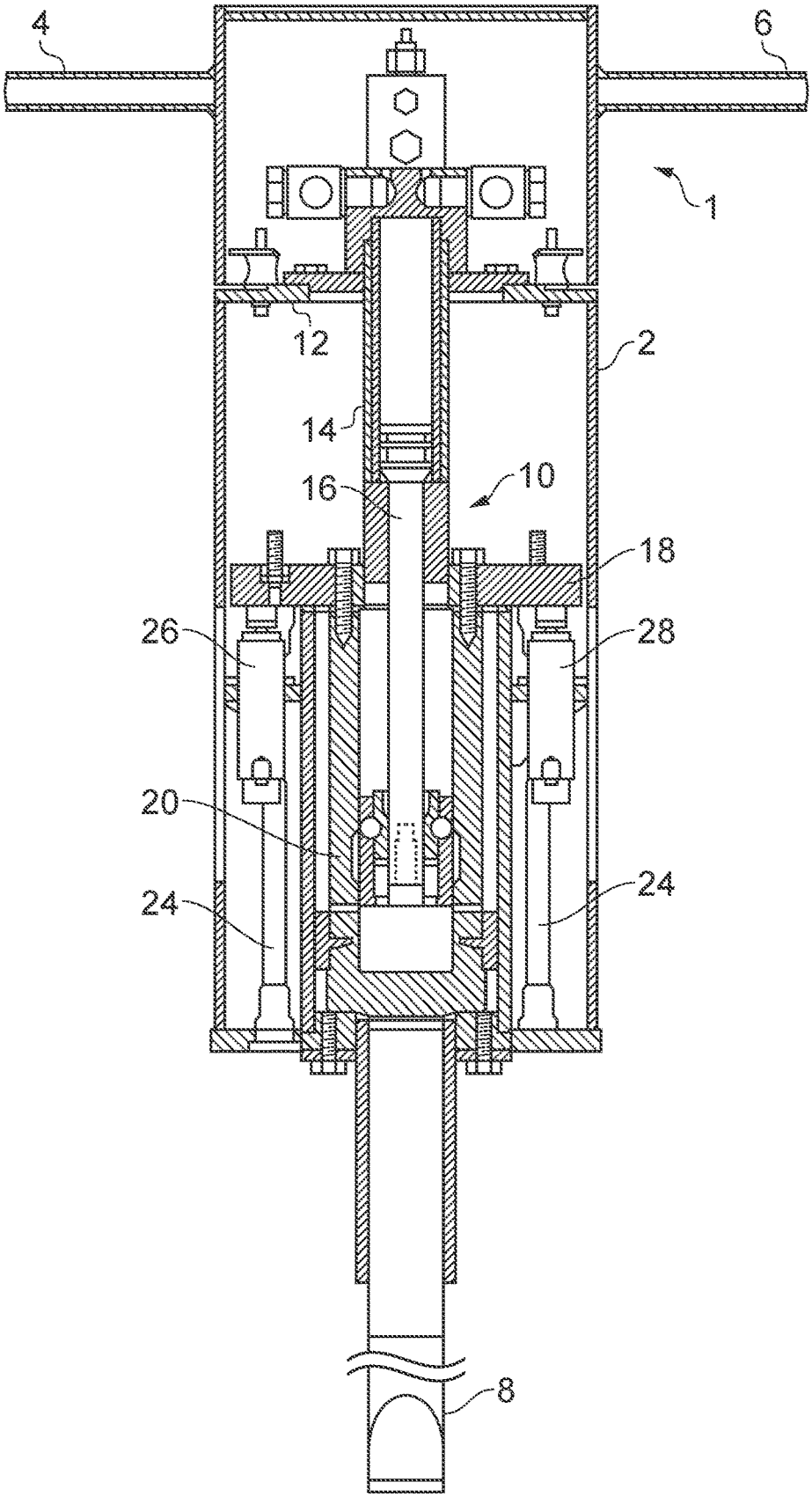
FIG. 1 shows an example of the related art, as described earlier.

A device of the present disclosure also advantageous since it provides a device having a substantially greater energy output per unit weight than either a purely pneumatic drill or the device as shown in FIG. 1. Hence masonry cutting operations take less time to perform with a device of the present disclosure. Thus any device powering or maneuvering the tool (for example a backhoe loader) can move off station sooner, hence use less fuel and reduce noise pollution.

Since the power tool 30 of the present disclosure is inherently more efficient, the carrier vehicle, which provides power to the tool 30, may operate at a lower engine power setting than would be required with a power tool of the related art, thereby extending the life of the carrier vehicle, and reducing fuel consumption.

In examples where the actuator 46, 146 is operated by hydraulic fluid delivered from a carrier vehicle, a power tool according to the present invention will require less work to be done by the fluid, and expose the fluid to less vibration and maintain the fluid at a lower temperature, thus extending the life of the hydraulic fluid. Additionally, during operation of the device of the present disclosure, hydraulic fluid is flowed under pressure to power the actuators 46, 146, but is not subject to extremes of pressure changes as would be experienced in a conventional hydraulic breaker. This also extends the life of the hydraulic fluid being used.

Additionally the multiple (e.g. six) rod 90 support structure, in combination with passages for the rods extending the full length of the body 70, provides an improved bearing surface for the body 70 to slide along, increases stability of body 70 as it moves along the rods 90, and hence decreases vibration during the impact and retraction strokes.

Additionally the body 70 is made as large as possible for the volume available in the casing of the power tool, thereby providing a larger momentum, and hence force, to strike the tool carrier 42. This provides an advantage over examples of the related art which comprise central rams (for example, as shown in FIG. 1) as to achieve the same mass in a central ram arrangement the body would have to be longer and/or have a greater diameter, thereby increasing the size of the casing and power tool as a whole.

The power tool of the present disclosure achieves high torque using leverage developed by the offset engagement members 82, 182 to retract the body 70 against a high retraction force provided by the ropes 100 to thereby develop a large potential energy, which in turn provides a large impulse force to the impact tool 42 when the body is released.

This provides an advantage over examples of the related art which comprise central rams (for example, as shown in FIG. 1) as such ram cylinders would need to be of significant diameter in order to be operable to achieve the same retraction force, which thus increases the size of the device as a whole, as well as requiring a source of higher pressure fluid than that required by a device of the present disclosure.

The power tool of the present disclosure also includes an advantageous damping system including the first damper 112 and second damper 114 which are operable to absorb shock loads imparted to the tool carrier 42 during a misfire. This is extremely important as it prevents vibration and loads being transmitted to the casing of the power tool 30 and hence to the vehicle carrying the power tool 30. Since the carrier vehicle is exposed to less vibration and shock loads, the life of its components are increased. Additionally, the operator of the carrier vehicle is more comfortable, and hence can operate the device more effectively.

The modular nature of the power tool 30 makes it easier to assemble, re-configure and maintain.

The tool carrier 42 also allows for easy replacement of tools, for example to achieve a different cutting operation, or to replace a damaged tool.

Although the figures of the present application show a jack hammer type tool, the power tool of the present disclosure may form part of any power tool where it is required to deliver a cyclic percussive force to a target object.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A power tool, comprising:
an impact tool having a head end;
a body, comprising:
a first flange, comprising:
a first engagement land, and
a first engagement edge;
a first actuator configured to move the body along an operational axis between
an impact position at which the body is operable to transfer impact energy to the head end of the impact tool, and
a retracted position spaced apart from the impact position along the operational axis;
the first actuator, comprising:
a first actuator rotational axis, and
a first engagement element offset from, and rotatable around, the first actuator rotational axis,
the first engagement element and the first flange being arranged relative to each such that:
at the impact position, the first engagement element is operable to engage with the first flange engagement edge, and as the first engagement element rotates around the first actuator rotational axis, the first engagement element
travels along the first flange engagement land; and
simultaneously urges the body in a direction away from the impact position toward the retracted position; and
at the retracted position the first engagement element is operable to move past the first flange engagement edge to disengage the body from the first engagement element, permitting the body to move on an impact stroke to the impact position,
wherein the body is further operable to travel along the operational axis between the impact position; and
a rest position spaced apart from the impact position in a direction away from the retracted position along the operational axis, and
at the rest position, the first engagement element is spaced apart from the first flange such that, as the first engagement element rotates about the first rotational axis, the body is not engageable by the first engagement element.

2. The power tool as claimed in claim 1, wherein:
the body, comprises:
a second flange, comprising:
a second engagement land, and
a second engagement edge; and
the power tool further comprises:
a second actuator configured to move the body along the operational axis, comprising:
a second actuator rotational axis,
a second engagement element offset from, and rotatable around, the second actuator rotational axis, the second engagement element and the second flange being arranged relative to each other such that:

at the impact position, the second engagement element is operable to engage with the second flange engagement edge, and as the second engagement element rotates around the second actuator rotational axis, the second engagement element travels along the second flange engagement land; and simultaneously urges the body in a direction away from the impact position toward the retracted position; and at the retracted position, the second engagement element is operable to move past the second flange engagement edge to disengage the body from the second engagement element, permitting the body to move on an impact stroke to the impact position.

3. The power tool as claimed in claim 2, wherein:

the first engagement element and the second engagement element are operable to rotate respectively about the first actuator rotational axis and the second actuator rotational axis, and are further operable such that:

the first engagement element engages with the first flange engagement edge at substantially a first same instant as the second engagement element engages with the second flange engagement edge; and the first engagement element disengages from the first flange engagement edge at substantially a second same instant as the second engagement element disengages from the second flange engagement edge.

4. The power tool as claimed in claim 2, wherein the second actuator rotational axis is perpendicular to the operational axis.

5. The power tool as claimed in claim 2, wherein the first actuator rotational axis is aligned with the second actuator rotational axis.

6. The power tool as claimed in claim 2, wherein:

the first flange extends away from the first flange engagement edge in a first direction away from the first actuator rotational axis; and the second flange extends away from the second flange engagement edge in a second direction away from the second actuator rotational axis, the first direction being in an opposite direction with respect to the second direction.

7. The power tool as claimed in claim 2, wherein:

the first actuator and the second actuator are operable to be hydraulically actuated;

each of the first actuator and the second actuator comprise a fluid coupling for fluid communication with a fluid supply to drive the each of the first actuator and the second actuator; and the fluid supply of the each of the first actuator and the second actuator is controllable such that the fluid supply pressure to the each of the first actuator and the second actuator is matched.

8. The power tool as claimed in claim 7, wherein the fluid supply of the each of the first actuator and the second actuator is in fluid communication with each other.

9. The power tool claim 2, wherein:

at the rest position the second engagement element is spaced apart from the second flange such that as the second engagement element rotates about the second rotational axis, the body is not engageable by the second engagement element.

10. The power tool as claimed in claim 1, wherein the first actuator rotational axis is perpendicular to the operational axis.

11. The power tool as claimed in claim 1, further comprising:

a plurality of rods held in a fixed relationship to one another by:

a first mount toward a first end of the plurality of rods, and a second mount spaced apart from the first mount along the operational axis toward a second opposite end of the plurality of rods;

the second mount being provided with an aperture through which the impact tool extends.

12. The power tool as claimed in claim 11, wherein:

the body defines passages, each of the passages accommodating one of the rods, the passages being configured such that the body translates between the impact position and the retracted position along at least the rods accommodated in the passages.

13. The power tool as claimed in claim 12, wherein the body is in slideable engagement with at least some of the rods.

14. The power tool as claimed in claim 12, wherein a first bearing unit is provided in each of the passages, the first bearing unit being configured to bear upon a rod accommodated in the each of the passages.

15. The power tool as claimed in claim 14, wherein a second bearing unit is provided in each of the passages, the second bearing unit being configured to bear upon the rod accommodated in the each of the passages, the second bearing unit being spaced apart from the first bearing unit along a length of the each of the passages.

16. The power tool as claimed in claim 11, wherein:

a first end of an array of elastic ropes is coupled to the body and a second opposite end of the array of elastic ropes is coupled to a third mount;

the array of elastic ropes being configured such that:

the body translates from the impact position to the retracted position in a retraction direction along the rods under action of at least one of the first actuator and the second actuator and against a force developed by the array of elastic ropes; and the body is biased to move in an impact direction along the rods toward the impact position from the retracted position by the array of elastic ropes while uncoupled from the at least one of the first actuator and the second actuator.

17. The power tool as claimed in claim 11, wherein:

a first casing extends between the first mount and the second mount;

a second casing extends from the second mount along the operational axis;

the second casing terminating in an end plate; and the impact tool extends out of an aperture in the end plate.

18. The power tool as claimed in claim 1, wherein:

the impact tool comprises a tool carrier, comprising:

a base member aligned with the operational axis, the head end of the impact tool being provided at one end of the base member for receiving impact energy, the base member having:

a foot end at an opposite end of the impact tool to the head end, the foot end being provided with a tool mount configured to transmit the impact energy to a tool; and a casing engagement feature provided between the head end and the foot end, at least part of the tool carrier being located within the second casing;

the second casing being provided with a tool carrier engagement feature complementary in shape to, and for interlocking engagement with, the tool carrier casing engagement feature to prevent rotation of the tool carrier relative to the second casing and around the operational axis, and permit relative movement between the tool carrier and the second casing along the operational axis, the tool carrier casing engagement feature comprising a lug that extends longitudinally along part of a length of the tool carrier base member such that, in use, the lug is aligned with the operational axis of the power tool;

the second casing engagement feature being provided as a groove configured to receive the lug of the tool carrier casing engagement feature, the groove being aligned with the operational axis of the power tool; and being configured to permit the tool carrier to move relative to the casing along the operational axis.

19. The power tool as claimed in claim 18, further comprising:

a plurality of rods held in a fixed relationship to one another by:

a first mount toward a first end of the plurality of rods, and a second mount spaced apart from the first mount along the operational axis toward a second opposite end of the plurality of rods;

the second mount being provided with an aperture through which the impact tool extends;

a support land extending from the impact tool base member part of a way between the head end and the foot end;

a first damping member provided between the support land and the second mount; and a second damping member provided between the support land and the second casing end plate.

20. The power tool as claimed in claim 19, wherein:

the support land extends radially outward from the tool carrier base member, and each lug extends radially outward from the support land.

* * * * *